US006569612B1

(12) United States Patent
Cosimbescu et al.

(10) Patent No.: US 6,569,612 B1
(45) Date of Patent: May 27, 2003

(54) PHOTOGRAPHIC ELEMENT CONTAINING A HIGH-DYE-YIELD COUPLER FOR PRODUCING A YELLOW HUE

(75) Inventors: Lelia Cosimbescu, Rochester, NY (US); Jared B. Mooberry, Rochester, NY (US); David T. Southby, Rochester, NY (US); Louis E. Friedrich, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/943,073

(22) Filed: Aug. 30, 2001

(51) Int. Cl.[7] ..... G03C 1/46

(52) U.S. Cl. ..... 430/505; 430/543; 430/557; 430/950; 430/359; 430/955; 430/226

(58) Field of Search ..... 430/505, 543, 430/557, 958, 359, 955, 226

(56) References Cited

U.S. PATENT DOCUMENTS 4,840,884 A 6/1989 Mooberry et al.
5,447,819 A 9/1995 Mooberry et al.
5,457,004 A 10/1995 Mooberry et al.
5,998,121 A * 12/1999 Southby et al. ..... 430/557
6,132,944 A 10/2000 Mooberry et al.

* cited by examiner

*Primary Examiner*—Geraldine Letscher
(74) *Attorney, Agent, or Firm*—Chris P. Konkol

(57) ABSTRACT

A color photographic element is disclosed comprising at least three light-sensitive units which have their individual sensitivities in different wavelength regions, comprising at least one imaging layer comprising a light-sensitive silver-halide emulsion, binder, and a yellow coupler represented by the following structure:

COUP
|
L
|
DYE

Wherein COUP is a photographic coupler residue capable of coupling with oxidized color developer to form a first yellow dye L is a linking group selected from the group consisting of —OC(═O)—, —OC(═S)—, —SC(═O)—, and —SC(═S)—, and —DYE is a releasable second yellow dye or yellow dye precursor, wherein COUP is an acetanilide compound that contains one or more electron-withdrawing groups such that the pKa at the coupling site is less than 8.7. Such yellow couplers improve activity and enhance dye densities.

39 Claims, No Drawings

PHOTOGRAPHIC ELEMENT CONTAINING A HIGH-DYE-YIELD COUPLER FOR PRODUCING A YELLOW HUE

FIELD OF THE INVENTION

This invention relates to a color photographic element containing a silver-halide emulsion layer and an associated high-dye-yield coupler that comprises a parent coupler that forms a first dye with an oxidized developer and, linked to the coupling site, a releasable second dye, wherein the parent coupler contains one or more electron-withdrawing groups such that the pKa at the coupling site is less than 8.7.

BACKGROUND OF THE INVENTION

U.S. Pat. No. 4,840,884 by Mooberry and Singer discloses high-dye-yield (HDY) couplers that react with oxidized color developer, typically in a conventional wet, alkaline, photographic process, to form one dye from the coupler parent and release a second dye or precursor of a second dye, usually a high extinction methine dye. Coupler coating loads can be decreased and/or density increases can be achieved by the use of such HDY couplers compared to ordinary two equivalent couplers. This patent (U.S. Pat. No. 4,840,884) discloses examples of hydrophilic sulfonamide solubilization of yellow couplers. In addition to incorporation of a sulfonamide in the coupler to enhance reactivity, the patent also discloses carboxyl solubilization in the dye moiety. It has been found, nevertheless, that couplers of this type, particularly those containing a coupler portion capable of forming a yellow dye upon coupling with oxidized developer, are often unsatisfactory from the standpoint of activity. Activity improvements can be obtained in couplers of this type when containing timing groups as disclosed in U.S. Pat. No. 5,447,819. These couplers have the general formula COUP— $(T)_m$—L—DYE and particular solubilizing groups are incorporated in the timing group (T) to enhance reactivity. It has been found, however, that such couplers containing a timing group present other problems. In particular, such couplers have been found to cause dark-keeping problems, wherein the disclosed HDY coupler can be unstable during keeping and can be oxidized in ambient surroundings, resulting in the premature release of the DYE portion of the coupler.

U.S. Pat. No. 5,457,004 describes high dye yield couplers having methine dye chromophores. Several of the described couplers (I-4, I-5, I-46, I-57 and I-60) disclose acyloxy links between the COUP and DYE groups. All contain sulfonamide-solubilized coupler moieties. Example I-60 incorporates a carboxyl group in the dye moiety as well. The sulfonamide couplers have proved to be less active than desired toward color developer.

Improved HDY couplers have been disclosed by Mooberry et al. in U.S. Pat. No. 6,132,944. This patent discloses HDY couplers that contain a release dye bonded through an acyloxy group at the coupling site where the coupler contains an arylhydroxy, sulfamoyl or sulfonamido group of pKa less than 8.8.

PROBLEM TO BE SOLVED BY THE INVENTION

A problem to be solved is to provide a silver halide photographic element containing a HDY yellow coupler that will exhibit improved activity. By improved activity is meant an improvement in Dmax, Gamma, Drange, and/or the ratio of Drange to the laydown of coupler, wherein Drange is equal to Dmax minus Dmin. Improved activity is especially relevant to color photothermographic systems, where achieving adequate yellow dye density has been a recurrent problem. Photothermographic systems involve heat processable photosensitive elements that are constructed so that after exposure they can be processed in a substantially dry state by applying heat.

Another problem is to provide light-sensitive imaging elements having yellow, magenta and cyan dye records of comparable density-forming ability and consistent stability in all three color records. Again, this is especially relevant to color photothermographic systems, where the dye images require the reaction of a developer released from a blocked developer and a dye-forming coupler within substantially dry gelatin. It has been found that, with conventional couplers, the yellow dye records have tended to provide less density than the magenta records.

In order to solve the above-mentioned problems and thereby improve the color recording quality of photographic systems, there is a need for a photographic element containing a stable HDY yellow coupler that will exhibit a higher activity than couplers heretofore discovered. Improving the color recording quality of color photothernographic systems has been particularly challenging.

SUMMARY OF THE INVENTION

These and other problems may be overcome by the practice of our invention. Applicants have found certain HDY yellow couplers with improved activity, which couplers therefore provide dye density enhancement. In particular, Applicants have found that HDY yellow couplers that are acetanilide compounds containing one or more electron-withdrawing groups, such that the pKa at the coupling site is less than 8.7 provide improved activity, such as dye density enhancement.

In one particular embodiment of the invention, such couplers are benzoylacetanilide compounds that contain, at the coupling site, a carbamyloxy group connected to a methine releasable dye.

In another particular embodiment, it has been found advantageous to use such HDY yellow couplers in the yellow record of a photothermographic element, in association with a blocked para-phenylenediamine developer.

The invention is also directed to a new class of yellow couplers. Finally, the invention is also directed to an imaging method comprising exposing a color photographic element of the invention to light and thereafter developing the element, either by conventional photoprocessing, with a developer solution, or by heating the element in the absence of an externally applied developing agent.

DETAILED DESCRIPTION OF THE INVENTION

As indicated above, an object of the present invention is to provide improved image dye formation in color photographic elements. In one embodiment, in particular, the invention provides a chromogenic (color) photothermographic element comprising radiation sensitive silver halide, a blocked developing agent, at least one yellow coupler that forms an image dye upon reaction of said compound with the oxidation product of the unblocked developing agent, and a hydrophilic binder, wherein the yellow coupler is selected as described below, such that the pKa at the coupling site is less than the pKa at the coupling site of the the following prior art compound:

CY-12

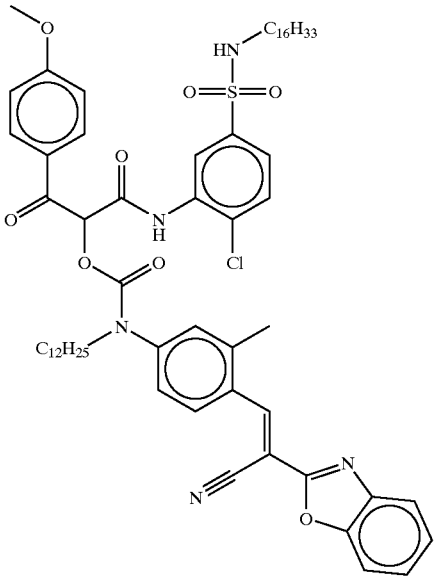

As described in the examples, the pKa at the coupling site of this compound CY-12 is 8.7, according to standard measurement. This compound is the same as compound I-4 in column 8 of U.S. Pat. No. 5,457,004, hereby incorporated by reference in its entirety. Preferably, the pKa of the present HDY coupler at the coupling site is less than or equal to 8.6 (at least 0.1 units less than the pKa at the coupling site of CY-12), preferably less than or equal to 8.5 (at least 0.2 units less than the pKa at the coupling site of CY-12), more preferably less than or equal to 8.0 (at least 0.7 units less than the pKa at the coupling site of CY-12), and most preferably less than or equal to about 7.7 (at least 1.0 unit less than the pKa at the coupling site of CY-12).

In a color photothermographic element, a blocked developer decomposes (i.e., unblocks) on thermal activation to release a developing agent that reacts with the coupler, wherein thermal activation is at a temperature of at least 60° C., preferably at least 80° C., more preferably at least 100° C. In dry processing embodiments, thermal activation preferably occurs at temperatures between about 80 to 180° C., preferably 100 to 160° C. In not completely dry development ("substantially dry") systems, thermal activation preferably occurs at temperatures between about 60 and 140° C. in the presence of added water, which however is used in an amount that is insufficient to well fully all the imaging layers. Preferably, any added water is neither highly acidic nor highly basic, with pH between 5 and 9. In one preferred embodiment of the invention, the photothermographic element comprises at least one organic silver salt (inclusive of complexes), acting as a silver donor.

The invention additionally relates to a method of image formation comprising developing an imagewise exposed photographic element by reacting a developer, either an externally applied developer or an incorporated blocked developer, with a yellow coupler according to the present invention. In the case of thermal development, the blocked developer decomposes on thermal activation to release a developing agent, the oxidized product of which reacts with the coupler to form a developed image.

In one embodiment of the invention, a positive image can be formed by scanning the developed image to form an electronic image representation (or "electronic record") from said developed image. This first electronic image can be digitized to form a digital image. Typically this digital image is modified to form a second electronic image representation, which can be stored, transmitted, printed or displayed.

The present invention further relates to a one-time use camera having a light sensitive photothermographic element comprising a support and a blocked developer that, on thermal activation, decomposes to react with a yellow coupler of the invention in at least one imaging layer of the element. The invention further relates to a method of image formation having the steps of imagewise exposing such a light sensitive photographic element in a one-time-use camera having a heater and thermally processing the exposed element in the camera.

As described in the "Summary of the Invention," the invention provides a photographic element containing a light sensitive silver halide emulsion layer having associated therewith a coupler represented by Formula I.

I

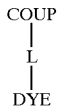

wherein:

COUP is a photographic coupler residue ("parent coupler") capable of coupling with oxidized color developer to form a first yellow dye;

L is a linking group selected from the group consisting of —OC(=O)—, —OC(=S)—, —SC(=O)—, and —SC(=S)—, and DYE is a releasable second yellow dye or dye precursor having a particular formula including a methine dye chromophore.

More specifically, L is a group which serves to connect COUP to the second dye. L has a formula so as to permit —L—DYE to be cleaved from the coupler upon the coupler's oxidative coupling with color developer during development processing. COUP combines with the oxidized developer to form the first dye and the fragment —L—DYE is then freed from COUP. Suitable groups for L permit the cleavage of the fragment from COUP and are cleaved from DYE during processing. Such groups also serve to effect a shifting of the dye hue so that, while the coupler is intact in the photographic element, the coupler will not unduly interfere with the transmission of light through the element.

As used herein and throughout the specification except where specifically stated otherwise, the term "alkyl" refers to an unsaturated or saturated, straight or branched chain alkyl group, including alkenyl and aralkyl, and includes cyclic alkyl groups, including cycloalkenyl, and the term "aryl" includes specifically fused aryl. When reference in this application is made to a particular moiety, or group, this means that the moiety may itself be unsubstituted or substituted with one or more substituents (up to the maximum possible number). For example, "alkyl" or "alkyl group" refers to a substituted or unsubstituted alkyl, while "aryl group" refers to a substituted or unsubstituted benzene (with up to five substituents) or higher aromatic systems. Also, unless otherwise specifically stated, use of the term "substituted" or "substituent" means any group or atom other than hydrogen. Additionally, when the term "group" or the like is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility of the compound in question. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro, hydroxyl; cyano, carboxyl, or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl, alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl, aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin- 1-yl, 2-oxo-5-tetradecylpyrrolin-1-yl, N-methyltetradecanamido, N-succinimido, N-phthalimido, 2,5-dioxo- 1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido, sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl, carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl, acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl, sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl, sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl, thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio, acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine, imino, such as 1-(N-phenylimido)ethyl, N-succinimido or 3-benzylhydantoinyl, phosphate, such as dimethylphosphate and ethylbutylphosphate, phosphite, such as diethyl and dihexylphosphite, a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

The particular substituents used may be selected by those skilled in the art to attain the desired photographic properties for a specific application and can include, for example, hydrophobic groups, solubilizing groups, blocking groups, releasing or releasable groups, etc. When a molecule has two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected. To control the migration of various components, it may be desirable to include a high molecular weight hydrophobe or "ballast" group in coupler molecules. Representative ballast .groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

In a preferred embodiment, the invention provides a photographic element containing a light sensitive silver halide emulsion layer having associated therewith a coupler represented by Formula IA.

IA

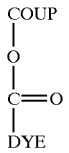

Wherein COUP and DYE are as described above, wherein DYE is a releasable second dye that, after release, is the same color as the first dye and is linked to OC═O by a moiety of the DYE having Formula (IB):

IB

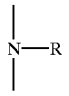

wherein R is a substituent, preferably a lower alkyl group.

More specifically, the parent coupler (COUP) of the invention is the portion of the coupler that combines with oxidized color developer, whether in a conventional solution process or in a non-traditional hybrid digital process, to form a yellow colored image dye. The various types of couplers are described more fully hereinafter. In the preferred embodiment of the invention, COUP comprises an acylacetanilide ring. Suitable examples include indoloylacetanilides and benzoylacetanilides.

More specifically, the second releasable dye (DYE) is, or forms, a yellow dye, i.e. the same color as that formed by COUP upon reaction with oxidized developer. When the yellow DYE is appended to the coupler through an appropriate linking group, for example an acyloxy group, it is conveniently shifted to the UV range and thus contributes little background color until detached from COUP in an imagewise fashion. DYE may include, but is not limited to, the methine type of dyes specified in U.S. Pat. No. 4,840,884. DYE may also include azo-type dyes, which may be preferred for reasons of dark stability even though the extinctions may be lower. Useful embodiments include the methine or azo dyes described in U.S. Pat. No. 5,457,004, hereby incorporated by reference in its entirety.

One useful embodiment of DYE has the formula:

II

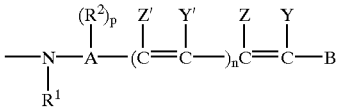

In formula II, $R^1$ is hydrogen or a substituted or unsubstituted alkyl or aryl (including heteroaryl) group. The $R^1$ substituent can be any substituent that does not adversely affect the coupler. $R^1$ can be, for example, an alkyl containing 1 to 42, typically 1 to 22 carbon atoms. Preferred $R^1$ groups are unsubstituted or substituted alkyl, such as alkyl containing 1 to 18 carbon atoms or unsubstituted or substituted aryl, such as phenyl. Suitably, $R^1$ may be methyl, ethyl, propyl, butyl, pentyl, etc. Cyclic or branched alkyl groups such as isopropyl, cyclopentyl or cyclohexyl have been found advantageous as have alkyl groups of 1 to 5 carbon atoms. The selection of lower alkyl $R^1$ groups may contribute somewhat to lowering the pKa of the HDY coupler. As mentioned above, the DYE is bonded to the linking L group through the —NR'— group of the DYE. The selection of this substituent can also have a significant effect on the resulting hue of DYE.

A is a substituted or unsubstituted aryl (including heteroaryl) ring containing up to three optional substituents $R^2$. Suitably, A is a phenyl, naphthyl, or thiazole ring. Preferably, each $R^2$ is independently a substituted or unsubstituted alkyl group which may form a ring with Z', and p is an integer from 0 to 3. Preferably, one or more $R^2$ substituents are alkyl groups of from 1 to 5 carbon atoms such as a methyl or propyl group.

Each Z, Z', and Y' is independently hydrogen or a substituent. Y is an electron withdrawing group. By electron withdrawing it is meant that the Hammett's sigma(para) constant value for Y is greater than zero. Constant values for various substituents are provided in Hansch and Leo, *Substituent Constants for Correlation Analysis in Chemistry and Biology*, Wiley, N.Y., 1979. Preferably, Y is a substituent having a Hammett's sigma(para) constant value of at least 0.3 and most preferably at least 0.4. Suitable examples are cyano, carboxyl, sulfonyl, and acyl groups. Preferably, Y is a cyano group.

n, which represents the number of conjugated vinyl groups and affects the hue of the dye, is 0, 1, or 2.

B is Y or a heterocycle having the formula:

IIA

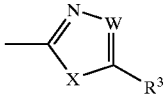

X is 0, S, or $N(R^5)$ where $R^5$ is hydrogen or alkyl of up to 22 carbon atoms. Most suitably, X is O. W is N or $C(R^4)$ where $R^4$ is hydrogen or a substituent. $R^3$ is a substituent linked to the heterocycle by a carbon or nitrogen atom of the substituent. Suitably, $R^3$ is a substituted or unsubstituted alkyl or aryl group. If desired, $R^3$ and $R^4$ may be linked to form a ring. It is provided that $R^3$ and $R^4$ may be linked to form a ring.

When $R^3$ and $R^4$ form a ring, a substituted or unsubstituted ring, particularly an aromatic ring, may be employed. Phenyl and naphthyl rings are examples. The ring may suitably contain one or more substituents of up to 20 carbon atoms each such as alkyl groups, e.g. methyl, i-propyl, t-butyl etc.

In a preferred embodiment, X is O, W is $C(R^4)$, and $R^3$ and $R^4$ form a phenyl ring so that B is a benzoxazole group.

As mentioned above, the first and second dyes in the high dye-yield coupler are the same color, namely yellow. By the same color it is meant they have an absorption maximum within 75 nm of each other. The first dye is not formed until the development process. The second dye is shifted to the non-visible region so long as DYE is bonded to the rest of the coupler via OC═O or other linking group, but becomes colored upon release.

Examples of useful COUP groups can be represented by the following structure:

III

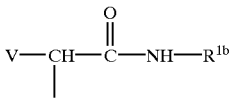

Where V is either —CN or —C(═O)$R^{1a}$, where $R^{1b}$ and $R^{1a}$ are as defined below for structure IIIA.

A free bond from the coupling site in the above formulae indicates a position to which the coupling release group or coupling-off group is linked. In the above formulae, when $R^{1a}$ or $R^{1b}$ contains a ballast or anti-diffusing group, it is selected so that the total number of carbon atoms is from 8 to 32 and preferably from 10 to 22.

Preferably, in Structure III, R1b is a subsituted or unsubstituted aryl or heterocyclic ring, and V is a cyano or an acyl group which acyl group comprises a substituted or unsubstituted aryl, alkyl, cyclic alkyl, amino, alkoxy or heterocylic moiety, wherein one or more electron-withdrawing groups are attached to one or more of said aryl or heterocyclic ring, and said aryl, alkyl, cyclic alkyl, amino, alkoxy or heterocylic moiety. More preferably, R1 b is a subsituted or unsubstituted aryl or heterocyclic ring and V is an acyl group which acyl group comprises a substituted or unsubstituted aryl, cyclic alkyl, or heterocylic moiety, wherein one or more electron-withdrawing groups are attached to one or more of said aryl or heterocyclic ring, and said aryl, cyclic alkyl, or heterocylic moiety.

In a preferred embodiment of the invention, COUP can be represented by the following structure:

IIIA

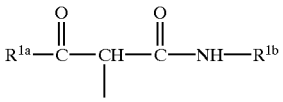

$R^{1a}$ represents an aliphatic- or alicyclic-hydrocarbon group, an aryl group, an alkoxyl group, an amino or substituted amino or a heterocyclic group. An aliphatic- or alicyclic hydrocarbon group represented by $R^{1a}$ preferably has at most 22 carbon atoms, may be substituted or unsubstituted, and the aliphatic hydrocarbon may be straight or branched. Useful examples of the groups as $R^{1a}$ include an isopropyl group, a cyclopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an axdiethylamino)isopropyl group, an α-(succinimido) isopropyl group, an α-(phthalimido)isopropyl group, an α-(benzenesulfonamido)isopropyl group, and the like.

$R^{1a}$ preferably presents an aryl group or a heterocyclic group. When $R^{1a}$ is an aryl group (especially a phenyl group), the aryl group may be substituted. The aryl group (e.g., a phenyl group) may be substituted with groups having not more than 32 carbon atoms such as an alkyl group, an alkenyl group, an alkoxy group, an alkoxycarbonyl group, an alkoxycarbonylamino group, an aliphatic- or alicyclic-amido group, an alkylsulfamoyl group, an alkylsulfonamido group, an alkylureido group, an aralkyl group and an alkyl-substituted succinimido group. (The aralkyl group may be further substituted with groups such as, for example, an aryloxy group, an aryloxycarbonyl group, an arylcarbamoyl group, an arylamido group, an arylsulfamoyl group, an arylsulfonamido group, and an arylureido group. $R^{1a}$ may also be substituted with an amino group which may be further substituted, for example, with groups such as a nitro group, a cyano group, a thiocyano group, or a halogen atom.

Preferred electron-withdrawing groups on the $R^{1a}$ group, most preferably when a phenyl group as mentioned above, are as follows: —$SO_2R'$, —$SO_2NBR'$, SOR', —$OSO_2R$, —$NO_2$, —Cl or other halogen, —$NHSO_2R'$, —CN, —$SO_2CF_3$, —OAr, —$CO_2R'$, —$CF_3$, —COOR', —CONR', —COR', and. OCOR' where R' is an substituted or unsubstituted organic moiety, preferably an alkyl or aryl group, more preferably in which the alkyl has 1 to 18 carbon atoms and in which the aryl is phenyl.

$R^{1a}$ may also represent substituents resulting from condensation of a phenyl group with other rings, such as a naphthyl group, a quinolyl group, an isoquinolyl group, a chromanyl group, a coumaranyl group, and a tetrahydronaphthyl group. These substituents may be further substituted repeatedly with at least one of above-described substituents for a phenyl group represented by $R^{1a}$.

When $R^{1a}$ represents a heterocyclic ring, the heterocyclic group is linked to a carbon atom of the carbonyl group of the acyl group in α-acylacetamido through one of the carbon atoms constituting the ring. Examples of such heterocyclic rings are thiophene, furan, pyran, pyrrole, pyrazole, pyridine, pyrazine, pyrimidine, pyridazine, indolizine, imidazole, thiazole, oxazole, triazine, thiadiazine and oxazine. These groups may further have a substituent or substituents on the ring thereof. Examples of the substituents include those defined for the aryl group represented by $R^{1a}$.

$R^{1b}$ is an aryl group (preferably a phenyl group) or a heterocyclic ring, and may be substituted with one or more electron withdrawing groups such as alkylsulfamoyl group. $R^{1b}$ can be further substituted with groups having not more than 32 carbon atoms such as an alkyl group, an alkenyl group, an alkoxy group, an alkoxycarbonyl group, an alkoxycarbonylamino group, an aliphatic- or alicyclic-amido group, an alkylsulfonamido group, an alkylureido group, an aralkyl group, an alkyl sufone, an amino group, an alkyl-substituted succinimido group, and the like. This aralkyl group may be further substituted with groups such as an aryloxy group, an aryloxycarbonyl group, an arylcarbamoyl group, an arylamido group, an arylsulfamoyl group, an arylsulfonamido group, and an arylureido group. The aryl or phenyl group represented by $R^{1b}$ may also be substituted with an amino group which may be further substituted with groups such as a nitro group, a cyano group, a thiocyano group, or a halogen atom. Preferred electron-withdrawing groups are —$SO_2R'$, —$SO_2NHR'$, SOR', —$OSO_2R$, —$NO_2$, —Cl or other halogen, —$NRSO_2R'$, —CN, —$SO_2CF_3$, —OAr, —$CO_2R'$, —$CF_3$, —COOR', —CONR', —COR', and —OCOR' where R' is an substituted or unsubstituted organic moiety, preferably an alkyl or aryl group, more preferably in which the alkyl has 1 to 18 carbon atoms and in which the aryl is phenyl.

$R^{1b}$ can also result from condensation of a phenyl group with other rings or subsituents, such as a naphthyl group, a quinolyl group, an isoquinolyl group, a chromanyl group, a coumaranyl group, and a tetrahydronaphthyl group. The resulting ring structure may be further substituted repeatedly with at least one of above-described substituents for the phenyl group represented by $R^{1b}$.

In the above structure III, the sigma (σ) total value ($\sigma_{total}$) of all substituents of the $R^{1a}$ and $R^{1b}$ is greater that 0.5, preferably greater than 0.6, more preferably greater than 0.7, and most preferably greater than 0.9. The substituents can be adjusted to achieve an decrease in pKa, for example, by adding electronegative groups to both or one of $R^{1a}$ and $R^{1b}$. (In general, the sigma (σ) values for any ortho substituent in the above formula is taken to be their para value.)

A preferred class of useful COUP groups can be represented by the following structure:

IIIA

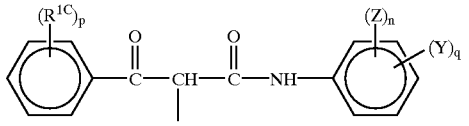

wherein Y is an electron-withdrawing group; Z is a non-electron-withdrawing group, $R^{1c}$ is a substituent as described above for $R^{1a}$, and q is 1 to 4, and each of n and q is 0 to 5. In a preferred embodiment, the sigma (a) value of the Y group in IELA should be greater than 0.2, preferably 0.2 to 0.9. Preferably, the sigma (σ) total value ($\sigma_{total}$) of all substituents Y, Z, and $R^{1c}$ is greater that 0.5, more preferably greater than 0.6, even more preferably greater than 0.7, and most preferably greater than 0.9. Preferably, the sigma (σ) value of at least one substituent is greater than 0.3, preferably greater than 0.35, more preferably 0.38 to 0.90. The substituents can be adjusted to achieve a decrease in pKa, for example, by adding electronegative groups to both or one of the rings. The sigma (σ) value used for any ortho substituent in the above formula is their para value.

In Structure III or IIIA, COUP preferably has at least one electron-withdrawing group that each has a sigma (σ) value of equal to or greater than that of chlorine (or greater than 0.2). Preferably, COUP does not have more than one substituent with a sigma (σ) value less than zero.

Electron-withdrawing groups on the acetanilide ring have a pKa lowering effect, so that suitable selection of the substituents will achieve a pKa of less than that of CY-12, as described above.

In a preferred embodiment, the HDY coupler has a chlorine substituent in the acetanilide ring and at least one additional electron-withdrawing group on the acetanilide ring, for example —$SO_2R'$ where R' is as defined above. Although the substituents on the acetanilide ring may have greater effect on the pKa at the coupling site, it may be preferable to provide at least some electron-withdrawing substituents on the benzoyl ring to achieve a desired pKa A preferred class of yellow HDY couplers of the present invention can be represented by the following formula:

IIIB

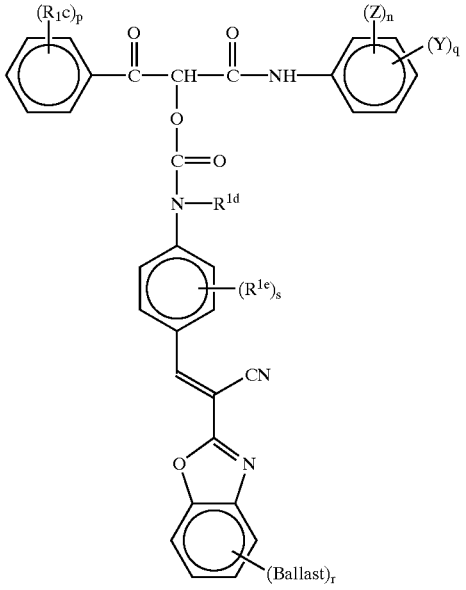

wherein the various groups are as defined above, r is 0 to 3, "Ballast" is a ballasting group having at least 4 carbon atoms, $R^{1d}$ is preferably an alkyl group having 1 to 6 carbon atoms (more preferably 1 to 4 carbon atoms) or a cycloalkyl group having 5 or 6 carbon atoms, and $R^{1e}$ is an alkyl or alkoxy group having 1 to 6 carbon atoms (more preferably 1 to 4 carbon atoms) and s is 0 to 3.

The following are examples of some specific yellow couplers useful in a photographic element in accordance with the present invention.

Y-1

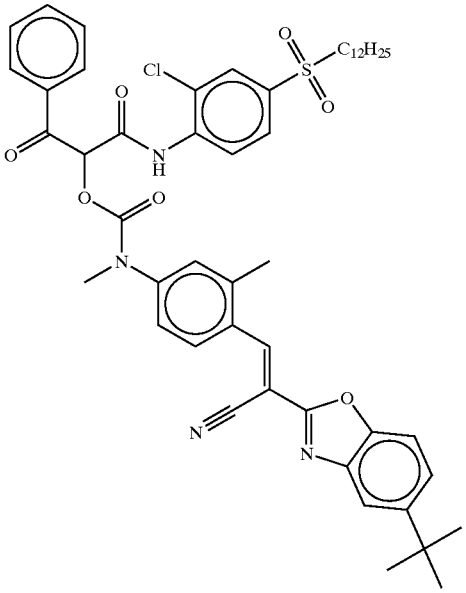

-continued

Y-2

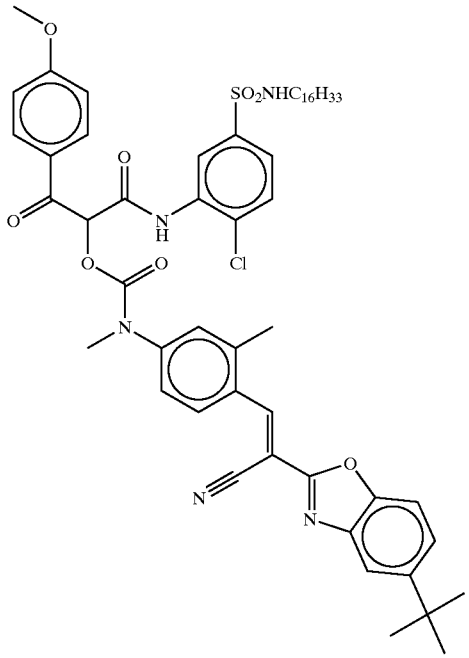

Y-3

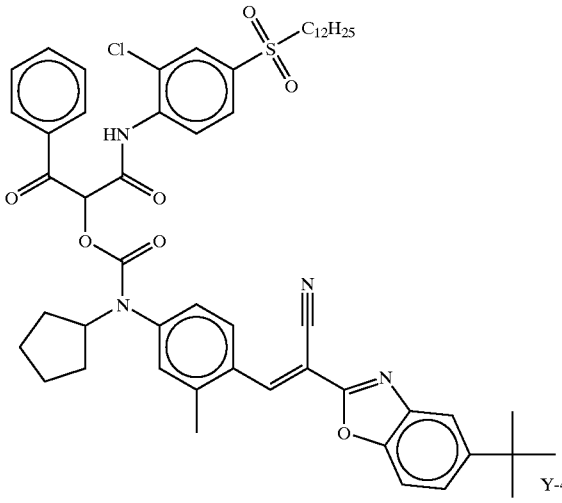

Y-4

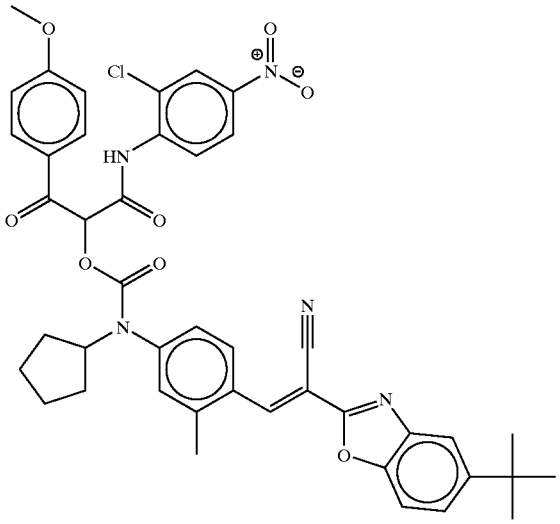

-continued
Y-5
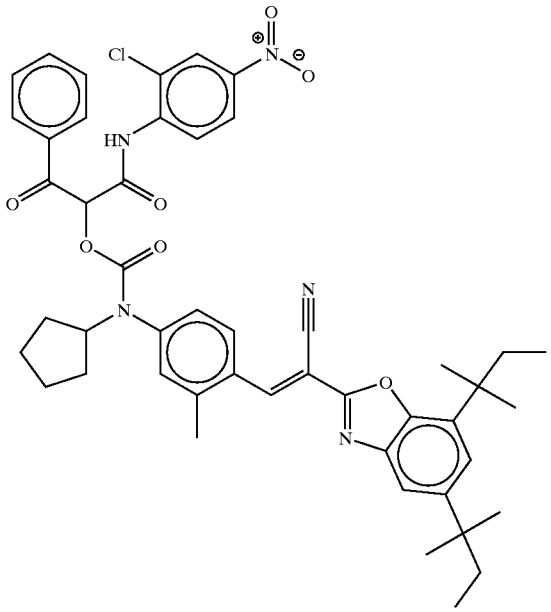
Y-6
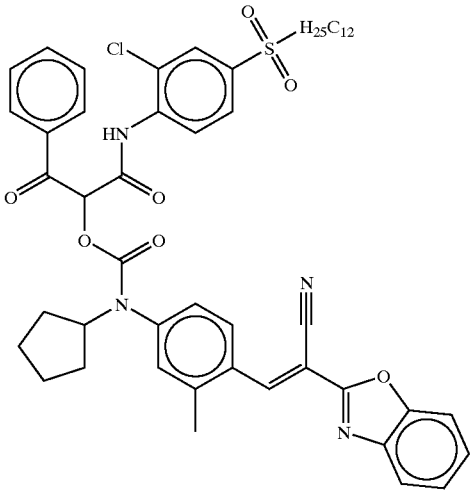
Y-7
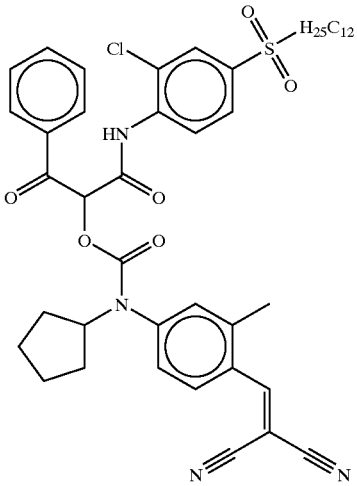
-continued
Y-8
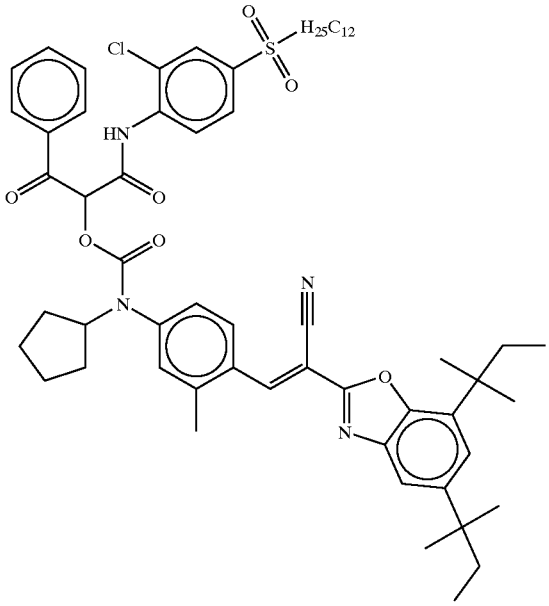
Y-9
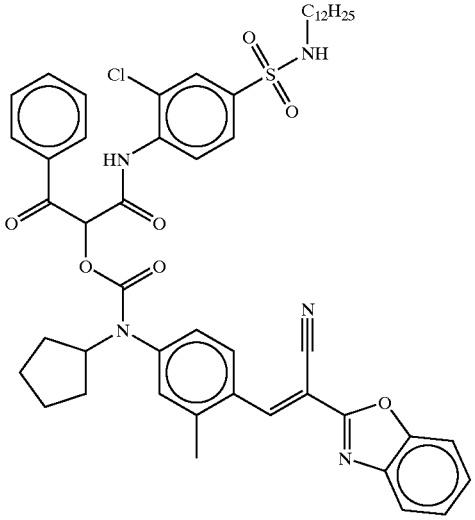
(10)
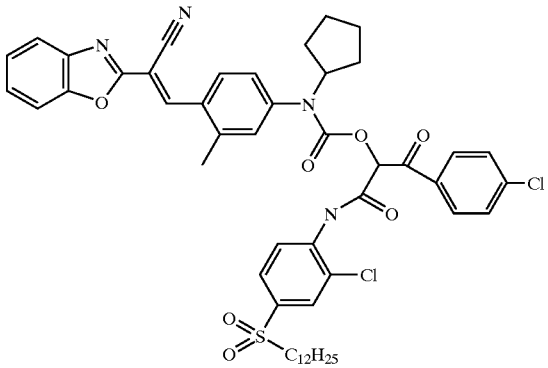

-continued
(11)
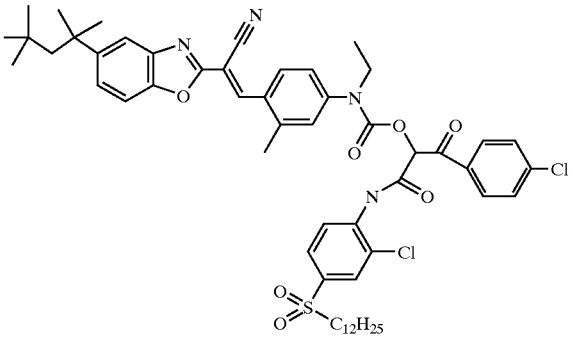
(12)
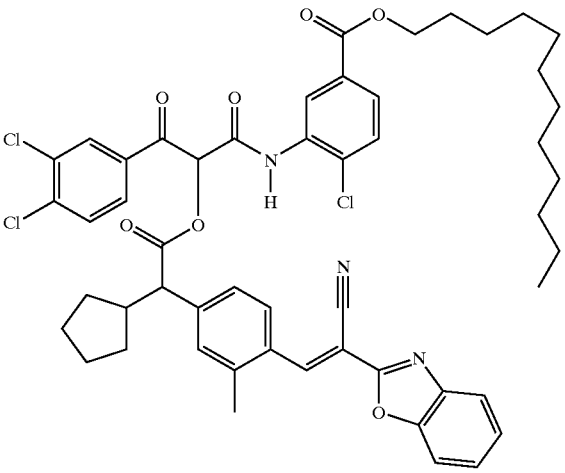
Y-13
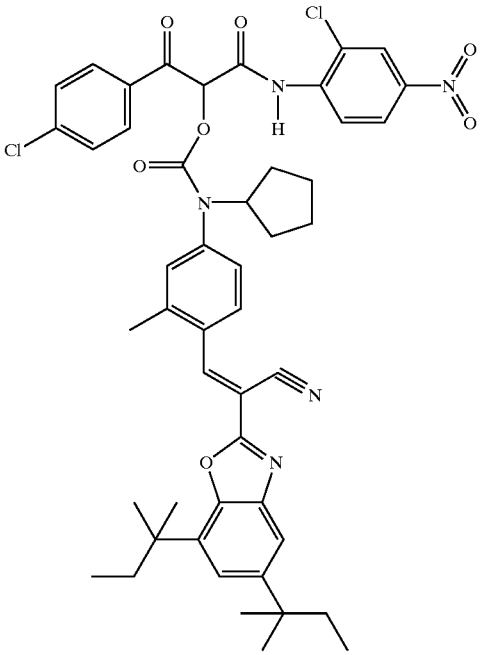
-continued
Y-14
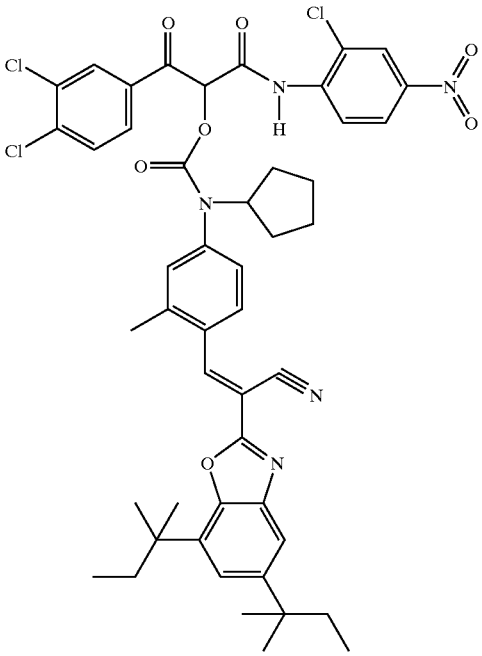
Y-15
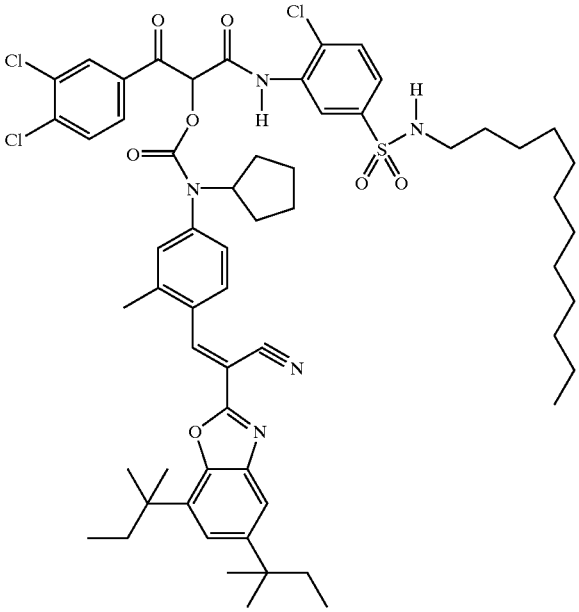

-continued
Y-16
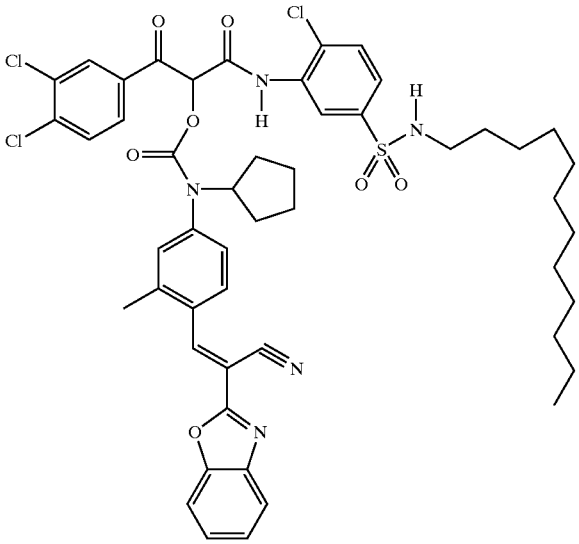
Y-17
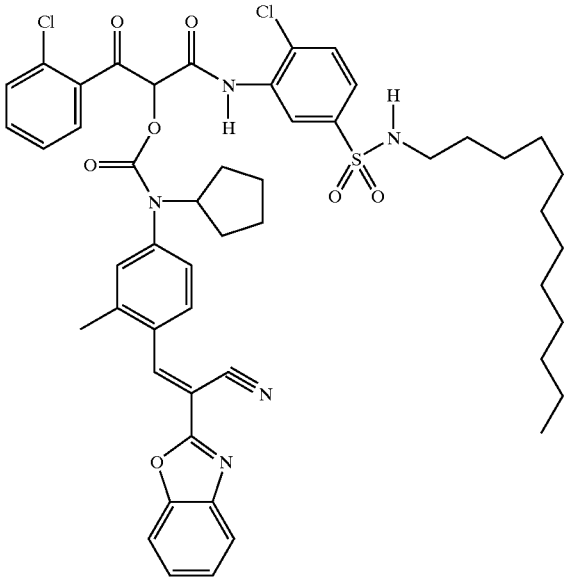
-continued
Y-18
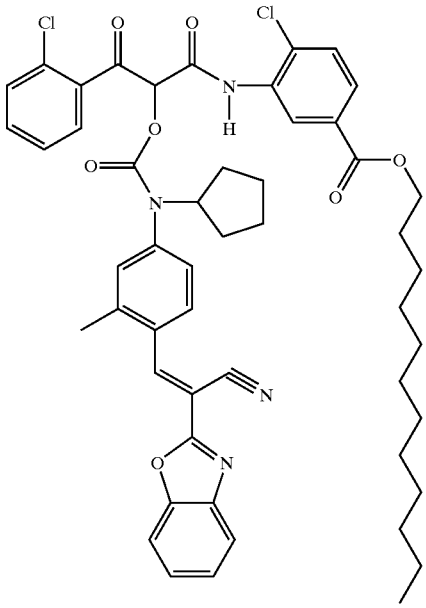
Y-19
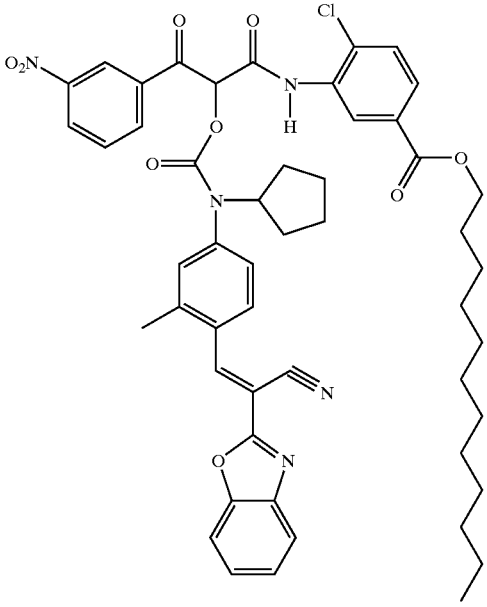

-continued

Y-20

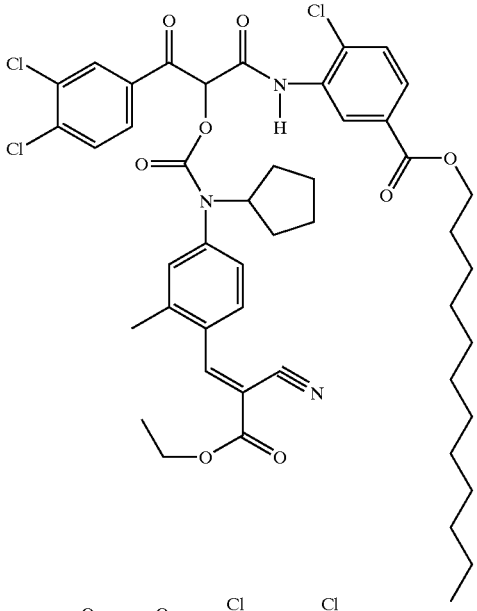

Y-21

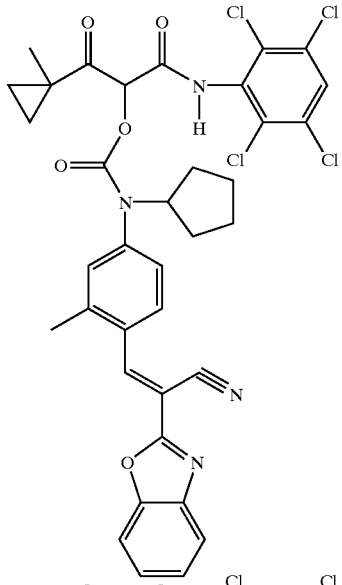

Y-22

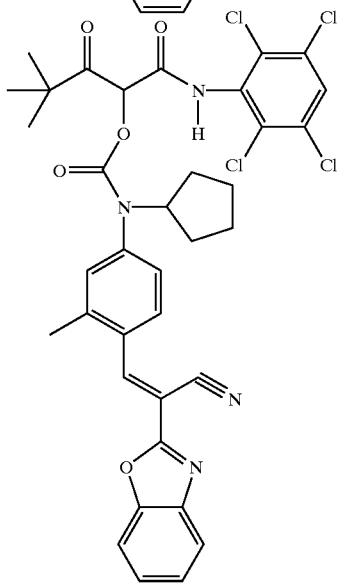

-continued

Y-23

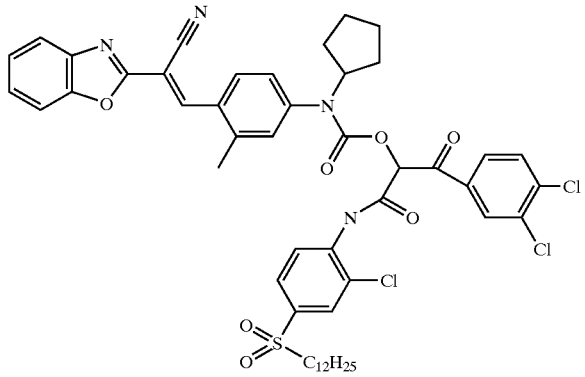

The materials of the invention can be used in any of the ways and in any of the combinations known in the art. Typically, the invention materials are incorporated in a melt and coated as a layer described herein on a support to form part of a photographic element.

The dye-forming HDY couplers useful in the invention can be incorporated in the imaging member in any manner known in the art. These methods include, but are not limited to, incorporation as oil-in-water emulsions, known colloquially in the photographic arts as "dispersions," as reverse phase emulsion, as solid particle dispersions, as multiphase dispersions, as molecular dispersions or "Fisher" dispersions, or as polymer loaded dispersions or loaded latex dispersions. While the HDY coupler can be employed in the member at any concentration that enables the desired formation of a multicolor image, it is preferred that the multifunctional dye forming coupler be applied to the member at between about 50 and 3000 mg/m$^2$. It is more preferred that the multifunctional dye forming coupler be applied to the member at between about 200 and 800 mg/m$^2$.

The imaging member can further comprise an incorporated solvent. In one embodiment the HDY coupler is provided as an emulsion in such a solvent. In this embodiment, any of the high boiling organic solvents known in the photographic arts as "coupler solvents" can be employed. In this situation, the solvent acts as a manufacturing aid. Alternatively, the solvent can be incorporated separately. In both situations, the solvent can further function as a coupler stabilizer, a dye stabilizer, a reactivity enhancer or moderator or as a hue shifting agent, all as known in the photographic arts. Additionally, auxiliary solvents can be employed to aid dissolution of the multifunctional dye forming coupler in the coupler solvent. Particulars of coupler solvents and their use are described in the aforesaid mentioned references and at *Research Disclosure,* Item 37038 (1995), Section IX, Solvents, and Section XI, Surfactants, incorporated herein by reference. Some specific examples of coupler solvents include, but are not limited to, tritoluyl phosphate, dibutyl phthalate, N,N-diethyldodecanamide, N,N-dibutyldodecanamide, tris(2-ethylhexyl)phosphate, acetyl tributyl citrate, 2,4-di-tert-pentylphenol, 2-(2-butoxyethoxy)ethyl acetate and 1,4-cyclohexyldimethylene bis(2-ethylhexanoate). The choice of coupler solvent and vehicle can influence the hue of dyes formed as disclosed by Merkel et al at U.S. Pat. Nos. 4,808,502 and 4,973,535. Typically, it is found that materials with a hydrogen bond donating ability can shift dyes bathochromically while materials with a hydrogen bond accepting ability can shift dyes hypsochromically. Additionally, use of materials with low polarizability can of itself promote hypsochromic dye hue shifts as well as promote dye aggregation. It is recognized that coupler ballasts often enable dyes and dye-coupler mixtures to function as self-solvents with a concomitant shift in hue. The polarizability, and the hydrogen bond donating and accepting ability of various materials are described by Kamlet et al in *J. Org. Chem,* 48, 2877–87 (1983), the disclosures of which are incorporated by reference.

The invention encompasses the possible use of a number of different couplers and one or more developing agents in the photothermographic element. There can be two different couplers or three different couplers in the imaging element. It is possible to have more than three couplers, for example, more than a single coupler in the same color unit. It is also possible to have three different developers (or blocked developers), two different developers (or blocked developers), or a single developer (or blocked developer). In one embodiment, there is one incorporated developer and three different couplers of different color. Thus, the HDY yellow coupler of the present invention can be used in combination with conventional or known couplers in other color records or can be used in combination with other novel couplers, for example, as disclosed in commonly assigned U.S. Pat. Nos. 6,517,981, issued date Feb. 11, 2000, hereby incorporated by reference.

When the formed image is intended for human viewing, at least one imaging layer is cyan dye forming, at least one other imaging layer is magenta dye forming, and at least one imaging layer is yellow dye forming. However, if the formed image is to be scanned, it is possible to produce other distinctly colored dyes. By distinctly colored is meant that the dyes formed differ in the wavelength of maximum adsorption by at least 50 nm. It is preferred that these dyes differ in the maximum adsorption wavelength by at least 65 nm and more preferred that they differ in the maximum adsorption wavelength by at least 80 nm. It is further preferred that, in addition to the yellow dye, a magenta and a cyan dye are formed. In another embodiment, an infrared forming dye-coupler combination is used, as disclosed in commonly assigned, copending U.S. Ser. No. 9/928834, hereby incorporated by reference. In yet another embodiment multiple cyan dye forming, magenta dye forming and yellow dye forming developers can be individually employed to form a greater gamut of colors or to form colors at greater bit depth.

A cyan dye is a dye having a maximum absorption at between 580 and 700 nm, with preferably a maximum absorption between 590 and 680 nm, more preferably a peak absorption between 600 and 670 nm and most preferably a peak absorption between 605 and 655 nm. A magenta dye is a dye having a maximum absorption at between 500 and 580 nm, with preferably a maximum absorption between 515 and 565 nm, more preferably a peak absorption between 520 and 560 nm and most preferably a peak absorption between 525 and 555 nm. yellow dye is a dye having a maximum absorption at between 400 and 500 nm, with preferably a maximum absorption between 410 and 480 nm, more preferably a peak absorption between 435 and 465 nm and most preferably a peak absorption between 445 and 455 nm.

In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red light recording layer unit forms a yellow, magenta or cyan dye having an absorption half peak bandwidth in the blue, green or red region of the spectrum, as is conventional in a color negative element intended for use in printing, or an absorption half-peak bandwidth in any other convenient region of the spectrum, ranging from the near ultraviolet (300–400 nm) through the visible and through the near infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

The concentrations and amounts of the developers and the dye-forming couplers according to the present invention will typically be chosen so as to enable the formation of dyes having a density at maximum absorption of at least 0.7, preferably a density of at least 1.0, more preferably a density of at least 1.3 and most preferably a density of at least 1.6. Further, the dyes will typically have a half height band width (HHBW) of between 70 and 170 nm in the region between 400 and 700 nm. Preferably, the HHBW will be less than 150 nm, more preferably less than 130 nm and most preferably less than 115 nm. Additional details of preferred dye hues are described by McInerney et al in U.S. Pat. Nos. 5,679,139, 5,679,140, 5,679,141 and 5,679,142, the disclosures of which are incorporated by reference.

In addition to HDY couplers, other couplers that may be used in the photographic element may optionally comprise coupling-off groups well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as (besides dye formation), dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305; 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers which can be used in addition to the HDY couplers of the present invention, which additional couplers form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

In addition to the foregoing, so-called "universal" or "washout" couplers may be employed, when using the HDY couplers in traditional non-PTG systems. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

Typically, couplers are incorporated in a silver halide emulsion layer in a molar ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

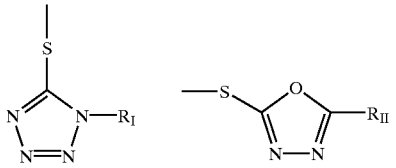

-continued

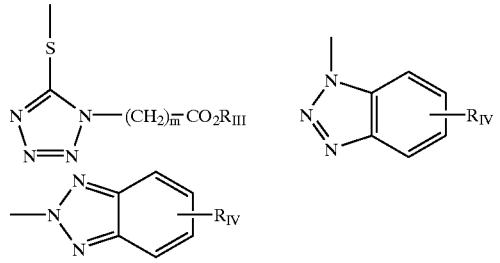

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

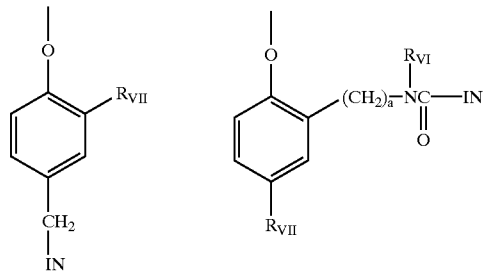

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

A typical color negative film construction useful in the practice of the invention is illustrated by the following element, SCN-1:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

Details of support construction are well understood in the art. Examples of useful supports are poly(vinylacetal) film, polystyrene film, poly(ethyleneterephthalate) film, poly (ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure*, September 1996, Number 389, Item 38957 (hereafter referred to as ("*Research Disclosure I*")

The photographic elements of the invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945, and U.S. Pat. No. 4,302,523.

In the above scheme, each of blue, green and red recording layer units BU, GU and RU are formed of one or more hydrophilic colloid layers and contain at least one radiation-sensitive silver halide emulsion, including the developing agent and, in certain embodiments, the common dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. In this case, the coupler containing layer is usually the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m. In another embodiment, sensitized layers disposed on two sides of a support, as in a duplitized film, can be employed.

In a preferred embodiment of this invention, involved films designed for scanning, the processed photographic film contains only limited amounts of color masking couplers, incorporated permanent Dmin adjusting dyes and incorporated permanent antihalation dyes. Generally, such films contain color masking couplers in total amounts up to about 0.6 mmol/m$^2$, preferably in amounts up to about 0.2 mmol/m$^2$, more preferably in amounts up to about 0.05 mmol/m$^2$, and most preferably in amounts up to about 0.01 mmol/m$^2$.

Particularly in photothermographic films, the incorporated permanent Dmin adjusting dyes are generally present in total amounts up to about 0.2 mmol/m$^2$, preferably in amounts up to about 0.1 mmol/m$^2$, more preferably in amounts up to about 0.02 mmol/m$^2$, and most preferably in amounts up to about 0.005 mmol/m$^2$. The incorporated permanent antihalation density is up to about 0.6 in blue, green or red density, more preferably up to about 0.3 in blue, green or red density, even more preferably up to about 0.1 in blue, green or red density and most preferably up to about 0.05 in blue, green or red Status M density.

Limiting the amount of color masking couplers, permanent antihalation density and incorporated permanent Dmin adjusting dyes serves to reduce the optical density of the films, after processing, in the 350 to 750 nm range, and thus improves subsequent scanning and digitization of image-wise exposed and processed films.

Overall, the limited Dmin and tone scale density enabled by controlling the quantity of incorporated color masking couplers, incorporated permanent Dmin adjusting dyes and antihalation and support optical density can serve to both limit scanning noise (which increases at high optical densities), and to improve the overall signal-to-noise characteristics of the film to be scanned. Relying on the digital correction step to provide color correction obviates the need for color masking couplers in the films.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 μm (most preferably less than 0.2 μm). Ultrathin tabular grain emulsions, those with mean tabular grain thicknesses of less than 0.07 μm, are specifically contemplated. However, in a preferred embodiment, a preponderance of low reflectivity grains is preferred. By preponderance is meant that greater than 50% of the grain projected area is provided by low reflectivity silver halide grains. It is even more preferred that greater than 70% of the grain projected area be provided by low reflectivity silver halide grains. Low reflective silver halide grains are those having an average grain having a grain thickness >0.06, preferably >0.08, and more preferable >0.10 microns. The grains preferably form surface latent images so that they produce negative images when processed in a surface developer in color negative film forms of the invention.

Illustrations of conventional radiation-sensitive silver halide emulsions are provided by *Research Disclosure* 1, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure* I, cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure* I, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm, et al., U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure*, I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be not more than 4.5 g/m$^2$ of silver, preferably less. Silver quantities of less than 4.0 g/m$^2$ are preferred, and silver quantities of less than 3.5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.0 g of coated silver per m$^2$ of support surface area in the element is necessary to realize an exposure latitude of at least 2.7 log E while maintaining an adequately low graininess position for pictures intended to be enlarged. Silver coverages in excess of 1.5 g/m$^2$ are preferred while silver coverages in excess of 2.5 g/m$^2$ are more preferred.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on peak shielding and broadening of the underlying layer spectral sensitivity.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent it is conventional practice to incorporate oxidized developing agent scavengers. Antistain agents (oxidized developing agent scavengers) can be selected from among those disclosed by *Research Disclosure* I, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure* I, Section VIII. Absorbing and scattering materials, B. Absorbing materials. In elements of the instant invention, magenta colored filter materials are absent from IL2 and RU.

The antihalation layer unit AHU typically contains a processing solution removable or decolorizable light absorbing material, such as one or a combination of pigments and dyes. Suitable materials can be selected from among those disclosed in *Research Disclosure* I, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure* I, Section IX. Coating physical property modifying addenda. The SOC overlying the emulsion layers additionally preferably contains an ultraviolet absorber, such as illustrated by *Research Disclosure* I, Section VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of-the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta \log E$) by doubling changes in density ($\Delta D$). Thus, gamma's as low as 1.0 or even 0.6 are contemplated and exposure latitudes of up to about 5.0 log E or higher are feasible. Gammas above 0.25 are preferred and gammas above 0.30 are more preferred. Gammas of between about 0.4 and 0.5 are especially preferred.

In photothermographic embodiments, typically one or more developer precursors are employed in the practice of this invention, which developer precursors are incorporated in the imaging element during manufacture, at least one of which is in reactive association with the yellow HDY coupler according to the present invention. When the term "associated" is employed, it signifies that a reactive compound is in or adjacent to a specified layer where, during processing, it is capable of reacting with other components.

In a preferred embodiment, the dye image is formed by the use of an incorporated developing agent, in reactive association with each color layer. More preferably, the incorporated developing agent is a blocked developing agent. Examples of blocking groups that can be used in photographic elements of the present invention include, but are not limited to, the blocking groups described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4,060,418, to Waxman and Mourning; and in U.S. Pat. No. 5,019,492. Other examples of blocking groups that can be used in photographic elements of the present invention include, but are not limited to, the blocking groups described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4, 060,418, to Waxman and Mourning; and in U.S. Pat. No. 5,019,492. Particularly useful are those blocking groups described in U.S. application Ser. No. 09/476,234, filed Dec. 30, 1999, IMAGING ELEMENT CONTAINING A BLOCKED PHOTOGRAPICALLY USEFUL COMPOUND; U.S. application Ser. No. 09/475,691, filed Dec. 30, 1999, IMAGING ELEMENT CONTAINING A BLOCKED PHOTOGRAPHICALLY USEFUL COMPOUND; U.S. application Ser. No. 09/475,703, filed Dec. 30, 1999, IMAGING ELEMENT CONTAINING A BLOCKED PHOTOGRAPHICALLY USEFUL COMPOUND; U.S. application Ser. No. 09/475,690, filed Dec. 30, 1999, IMAGING ELEMENT CONTAINING A BLOCKED PHOTOGRAPHICALLY USEFUL COMPOUND; and U.S. application Ser. No. 09/476,233, filed Dec. 30, 1999, PHOTOGRAPHIC OR PHOTOTHERMOGRAPHIC ELEMENT CONTAINING A BLOCKED PHOTOGRAPHICALLY USEFUL COMPOUND. In one embodiment of the invention, the blocked developer may be represented by the following Structure IV:

$$\text{DEV—(LINK 1)}_l\text{—(TIME)}_m\text{—(LINK 2)}_n\text{—B} \qquad \text{IV}$$

wherein,

DEV is a silver-halide color developing agent according to the present invention;

LNK 1 and LINK 2 are linking groups;

TIME is a timing group;

1 is 0 or 1;

m is 0, 1, or 2;

n is 0 or 1;

1+n is 1 or 2;

B is a blocking group or B is:

$$\text{—B'—(LINK 2)}_n\text{—(TIME)}_m\text{—(LINK 1)}_l\text{—DEV}$$

wherein B' also blocks a second developing agent DEV.

In a preferred embodiment of the invention, LINK 1 or LINK 2 are of Structure V:

V

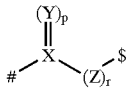

wherein

X represents carbon or sulfur;

Y represents oxygen, sulfur of N—$R_1$, where $R^1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK I) or TIME (for LINK 2):

$ denotes the bond to TIME (for LINK 1) or $T_{(t)}$ substituted carbon (for LINK 2).

Illustrative linking groups include, for example,

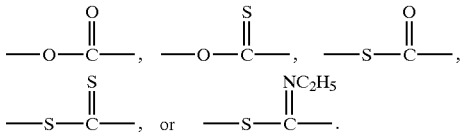

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. No. 4,409,323; 4, 421,845; Japanese Applications 57-188035; 58-98728; 58-209736; 58-209738); and (4) groups using an intramolecular nucleophilic substitution reaction (U.S. Pat. No. 4,248,962).

Although the present invention is not limited to any type of developing agent or blocked developing agent, the following are merely some examples of photographically useful blocked developers that may be used in the invention to produce developers of Structure III.

D-1

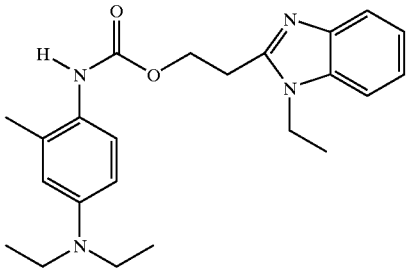

D-2

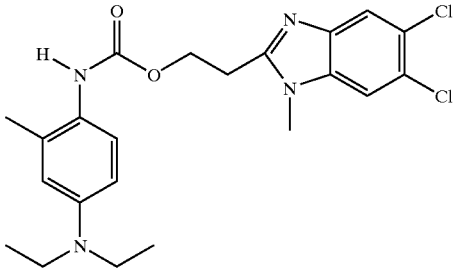

-continued

D-3

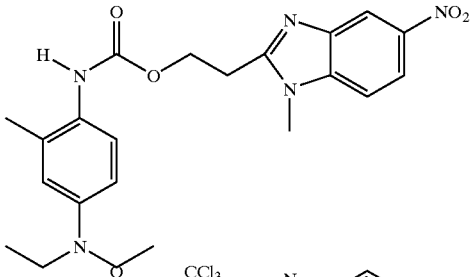

D-4

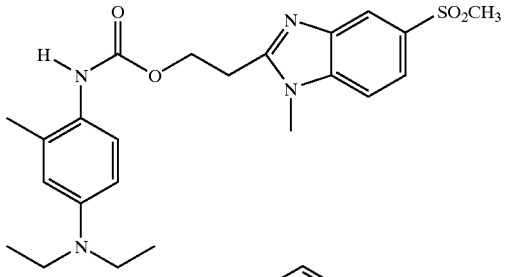

D-5

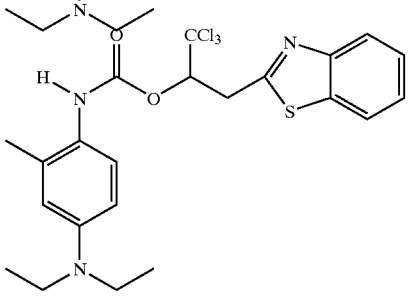

D-6

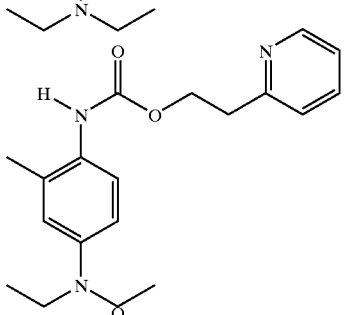

D-7

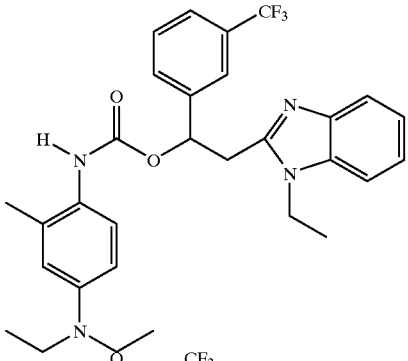

D-8

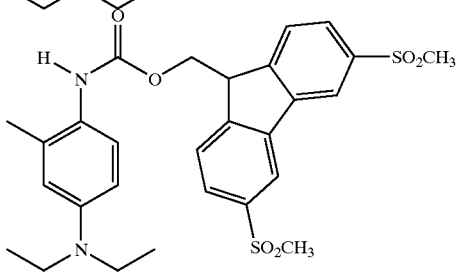

D-9

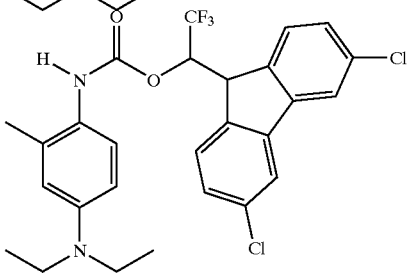

D-10

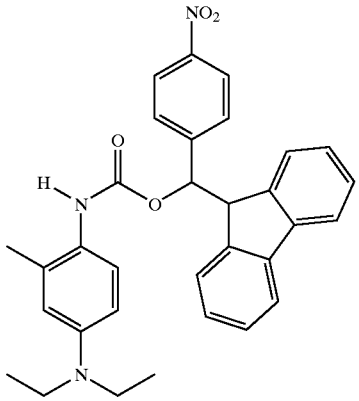

D-11

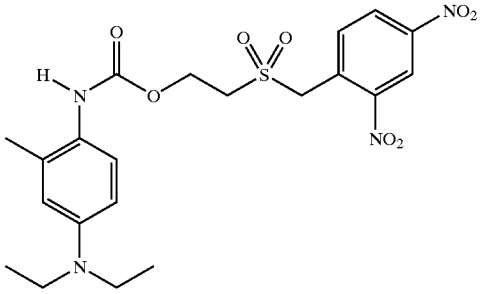

D-12

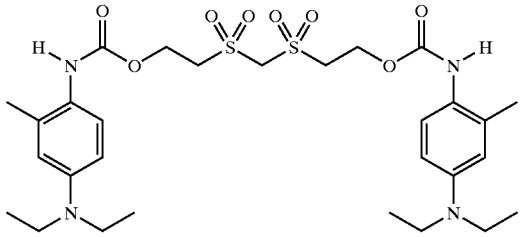

A number of modifications of color negative elements have been suggested for accommodating scanning, as illustrated by *Research Disclosure* I, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image that, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

When conventional yellow, magenta, and cyan image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. In a like vein, it is preferred that the gamma ratios be greater than 0.8, more preferred that they be greater than 0.85 and most preferred that they be greater than 0.9. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photothermographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al, U.S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087, providing a film patrone or cartridge removable in an axial direction as described by Takei et al at U.S. Pat. Nos. 4,890,130 and 5,063,400; providing an electronic flash means as described at Ohmura et al, U.S. Pat. No. 4,896,178; providing an externally operable member for effecting exposure as described at Mochida et al, U.S. Pat. No. 4,954,857; providing film support with modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613, by Zander U.S. Pat. No. 5,200,777, by Dowling et al U.S. Pat. No. 5,031,852, and by Robertson et al U.S. Pat. No. 4,834,306. Narrow bodied one-time-use cameras suitable for employing thrust cartridges in this way are described by Tobioka et al U.S. Pat. No. 5,692,221.

Cameras may contain a built-in processing capability, for example a heating element. Designs for such cameras including their use in an image capture and display system are disclosed in Stoebe, et al., U.S. patent application Ser. No. 09/388,573 filed Sep. 1, 1999, incorporated herein by reference. The use of a one-time use camera as disclosed in said application is particularly preferred in the practice of this invention.

Photographic elements of the present invention are preferably imagewise exposed using any of the known techniques, including those described in *Research Disclosure* I, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). Photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers.

The elements as discussed above may serve as origination material for some or all of the following processes: image scanning to produce an electronic rendition of the capture image, and subsequent digital processing of that rendition to manipulate, store, transmit, output, or display electronically that image.

As mentioned above, the photographic elements of the present invention can be photothermographic elements of the type described in *Research Disclosure* 17029 are included by reference. The photothermographic elements may be of type A or type B as disclosed in *Research Disclosure* I. Type A elements contain in reactive association a photosensitive silver halide, a reducing agent or developer, an activator, and a coating vehicle or binder. In these systems development occurs by reduction of silver ions in the photosensitive silver halide to metallic silver. Type B systems can contain all of the elements of a type A system in addition to a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350, 4,264,725 and 4,741,992.

A photothermographic element comprises a photosensitive component that consists essentially of photographic silver halide. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogenratom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Furthermore, a silver salt of a compound containing an imino group can be used. Preferred examples of these compounds include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

A second silver salt with a fog inhibiting property may also be used. The second silver organic salt, or thermal fog inhibitor, according to the present invention include silver salts of thiol or thione substituted compounds having a heterocyclic nucleus containing 5 or 6 ring atoms, at least one of which is nitrogen, with other ring atoms including carbon and-up to two hetero-atoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 2-mercaptobenzimidazole, a silver salt of 2-mercapto-5-aminothiadiazole, a silver salt of 5-carboxylic-l-methyl-2-phenyl-4-thiopynidine, a silver salt of mercaptotriazine, a silver salt of 2-mercaptobenzoxazole.

The second organic silver salt may be a derivative of a thionamide. Specific examples would include but not be limited to the silver salts of 6-chloro-2-mercapto benzotbiazole, 2-mercapto-thiazole, naptho( 1,2-d)thiazole-2( 1H)-thione, 4-methyl-4-thiazoline-2-thione, 2-thiazolidinethione, 4,5-dimethyl-4-thiazoline-2-thione, 4-methyl-5-carboxy-4-thiazoline-2-thione, and 3-(2-carboxyethyl)-4-methyl-4-thiazoline-2-thione.

Preferably, the second organic silver salt is a derivative of a mercapto-triazole. Specific examples would include, but not be limited to, a silver salt of 3-mercapto-4-phenyl-1,2,4 triazole and a silver salt of 3-mercapto-1,2,4-triazole.

Most preferably the second organic salt is a derivative of a mercapto-tetrazole. In one preferred embodiment, a mercapto tetrazole compound useful in the present invention is represented by the following structure VI:

VI

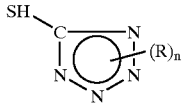

wherein n is 0 or 1, and R is independently selected from the group consisting of substituted or unsubstituted alkyl, aralkyl, or aryl. Substituents include, but are not limited to, C1 to C6 alkyl, nitro, halogen, and the like, which substituents do not adversely affect the thermal fog inhibiting effect of the silver salt. Preferably, n is 1 and R is an alkyl having 1 to 6 carbon atoms or a substituted or unsubstituted phenyl group. Specific examples include but are not limited to silver salts of 1-phenyl-5-mercapto-tetrazole, 1-(3-acetamido)-5-mercapto-tetrazole, or 1-[3-(2-sulfo)benzamidophenyl)-5-mercapto-tetrazole.

The photosensitive silver halide grains and the organic silver salt are coated so that they are in catalytic proximity during development. They can be coated in contiguous layers, but are preferably mixed prior to coating. Conventional mixing techniques are illustrated by Research Disclosure, Item 17029, cited above, as well as U.S. Pat. No. 3,700,458 and published Japanese patent applications Nos. 32928/75, 13224/74, 17216/75 and 42729/76.

The photothermographic element can comprise a thermal solvent. Examples of useful thermal solvents. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Examples of toning agents and toning agent combinations are described in, for example, *Research Disclosure,* June 1978, Item No. 17029 and U.S. Pat. No. 4,123,282.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, and toning agents, such as described in *Research Disclosure*, December 1978, Item No. 17643 and *Research Disclosure,* June 1978, Item No. 17029.

After imagewise exposure of a photothermographic element, the resulting latent image can be developed in a variety of ways. The simplest is by overall heating the element to thermal processing temperature. This overall heating merely involves heating the photothermographic element to a temperature within the range of about 90° C .to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed by Stoebe, et al., U.S. Pat. No. 6,062,746 and Szajewski, et al., U.S. Pat. No. 6,048,110, commonly assigned, which are incorporated herein by reference. The use of an apparatus whereby the processor can be used to write information onto the element, information which can be used to adjust processing, scanning, and image display is also envisaged. This system is disclosed in now allowed Stoebe, et al., U.S. patent applications Ser. Nos. 09/206,914 filed Dec. 7, 1998 and 09/333,092 filed Jun. 15, 1999, which are incorporated herein by reference.

Thermal processing is preferably carried out under ambient conditions of pressure and humidity. Conditions outside of normal atmospheric pressure and humidity are useful.

In view of advances in the art of scanning technologies, it has now become natural and practical for photothermographic color films such as disclosed in EP 0762 201 to be scanned, which can be accomplished without the necessity of removing the silver or silver-halide from the negative, although special arrangements for such scanning can be made to improve its quality. See, for example, Simmons U.S. Pat. No. 5,391,443.

Nevertheless, retained silver halide can scatter light, decrease sharpness and raise the overall density of a film thus leading to impaired scanning. Further, retained silver halide can printout to ambient/viewing/scanning light, render non-imagewise density, degrade signal-to noise of the original scene, and raise density even higher. Finally, the retained silver halide and organic silver salt can remain in reactive association with the other film chemistry, making the film unsuitable as an archival media. Removal or stabilization-of these silver sources are necessary to render a film to an archival state.

Furthermore, the silver coated in such films (silver halide, silver donor, and metallic silver) is unnecessary to the dye image produced, and this silver is valuable and the desire is to recover it is high.

Thus, it may be desirable to remove, in subsequent processing steps, one or more of the silver containing components of a film, even if designed for scanning: the silver halide, one or more silver donors, the silver-containing thermal fog inhibitor if present, and/or the silver metal. The three main sources are the developed metallic silver, the silver halide, and the silver donor. Alternately, it may be desirable to stabilize the silver halide in the photothermographic film. Silver can be wholly or partially stabilized/removed based on the total quantity of silver and/or the source of silver in the film.

The removal of the silver halide and silver donor can be accomplished with a common fixing chemical as known in the photographic arts. Specific examples of useful chemicals include: thioethers, thioureas, thiols, thiones, thionamides, amines, quaternary amine salts, ureas, thiosulfates, thiocyanates, bisulfites, amine oxides, iminodiethanol -sulfur dioxide addition complexes, amphoteric amines, bis-sulfonylmethanes, and the carbocyclic and heterocyclic derivatives of these compounds. These chemicals have the ability to form a soluble complex with silver ion and transport the silver out of the film into a receiving vehicle. The receiving vehicle can be another coated layer (laminate) or a conventional liquid processing bath.

The stabilization of the silver halide and silver donor can also be accomplished with a common stabilization chemical. The previously mentioned silver salt removal compounds can be employed in this regard. With stabilization, the silver is not necessarily removed from the film, although the fixing agent and stabilization agents could very well be a single chemical. The physical state of the stabilized silver is no longer in large (>50 nm) particles as it was for the silver halide and silver donor, so the stabilized state is also advantaged in that light scatter and overall density is lower, rendering the image more suitable for scanning.

The removal of the metallic silver is more difficult than removal of the silver halide and silver donor. In general, two reaction steps are involved. The first step is to bleach the metallic silver to silver ion. The second step may be identical to the removal/stabilization step(s) described for silver halide and silver donor above. Metallic silver is a stable state that does not compromise the archival stability of the film. Therefore, if stabilization of the film is favored over removal of silver, the bleach step can be skipped and the metallic silver left in the film. In cases where the metallic silver is removed, the bleach and fix steps can be done together (called a blix) or sequentially (bleach+fix).

The process could involve one or more of the scenarios or permutations of steps. The steps can be done one right after another or can be delayed with respect to time and location. For instance, heat development and scanning can be done in a remote kiosk, then bleaching and fixing accomplished several days later at a retail photofinishing lab. In one embodiment, multiple scanning of images is accomplished. For example, an initial scan may be done for soft display or a lower cost hard display of the image after heat processing, then a higher quality or a higher cost secondary scan after stabilization is accomplished for archiving and printing, optionally based on a selection from the initial display.

For illustrative purposes, a non-exhaustive list of photothermographic film processes involving a common dry heat development step are as follows:

1. heat development=>scan=>stabilize (for example, with a laminate)=>scan=>obtain returnable archival film.
2. heat development=>fix bath=>water wash=>dry=>scan =>obtain returnable archival film
3. heat development=>scan=>blix bath=>dry=>scan =>recycle all or part of the silver in film
4. heat development=>bleach laminate=>fix laminate =>scan=>(recycle all or part of the silver in film)
5. heat development=>scan=>blix bath=>wash=>fix bath=>wash=>dry=>obtain returnable archival film
6. heat development=>relatively rapid, low quality scan
7. heat development=>bleach=>wash=>fix=>wash=>dry =>relatively slow, high quality scan In a preferred embodiment of a photothermographic film according to the present invention, the processing time to first image (either hard or soft display for customer/consumer viewing), including (i) thermal development of a film, (ii) scanning, and (iii) the formation of the positive image from the developed film, is suitably less than 5 minutes, preferably less than 3.5 minutes, more preferably less than 2 minutes, most preferably less than about 1 minute. In one embodiment, such film might be amenable to development at kiosks, with the use of simple dry or apparently dry equipment. Thus, it is envisioned that a consumer could bring an imagewise exposed photographic film, for development and printing, to a kiosk located at any one of a number of diverse locations, optionally independent from a wet-development lab, where the film could be developed and printed without any manipulation by third-party technicians. A photothermographic color film, in which a silver-halide-containing color photographic element after imagewise exposure can be developed merely by the external application of heat and/or relatively small amounts of alkaline or acidic water, but which same film is also amenable to development in an automated kiosk, preferably not requiring third-party manipulation, would have significant advantages. Assuming the availability and accessibility of such kiosks, such photothermographic films could potentially be developed at any time of day, "on demand," in a matter minutes, without requiring the participation of third-party processors, multiple-tank equipment and the like. Optional, such photographic processing could potentially be done on an "as needed" basis, even one roll at a time, without necessitating the high-volume processing that would justify, in a commercial setting, equipment capable of high-throughput. Color development and subsequent scanning of such a film could readily occur on an individual consumer basis, with the option of generating α-display element corresponding to the developed color image. By kiosk is meant an automated free-standing machine, self-contained and (in exchange for certain payments) capable of developing a roll of imagewise exposed film on a roll-by-roll basis, without the intervention of technicians or other third-party persons such as necessary in wet-chemical laboratories. Typically, the customer will initiate and control the carrying out of film processing and optional printing by means of a computer interface. Such kiosks typically will be less than 6 cubic meters in dimension, preferably 3 cubic meters or less in dimension, and hence commercially transportable to diverse locations. Such kiosks may optionally comprise a heater for color development, a scanner for digitally recording the color image, and a device for transferring the color image to a display element.

Photothermographic or photographic elements of the present invention can also be subjected to low volume processing ("substantially dry" or "apparently dry") which is defined as photographic processing where the volume of applied developer solution is less than one times the volume of solution required to swell the photographic element. This processing may take place by a combination of solution application, external layer lamination, and heating. The low volume processing system may contain any of the elements described above. In addition, it is specifically contemplated that any components described in the preceding sections that are not necessary for the formation or stability of latent image in the origination film element can be removed from the film element altogether and contacted at any time after exposure for the purpose of carrying out photographic processing, using the methods described below.

Photographic elements designed for low-volume processing may receive some or all of the following three treatments:

(I) Application of a solution directly to the film by any means, including spray, inkjet, coating, gravure process and the like.

(II) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a image-wise manner to the auxiliary processing element.

Heating of a photothermographic element during processing may be effected by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C.

Once yellow, magenta, and cyan dye image records (or the like) have been formed in the processed photographic elements of the invention, conventional techniques can be employed for retrieving the image information for each color record and manipulating the record for subsequent creation of a color balanced viewable image. For example, it is possible to scan the photothermographic element successively within the blue, green, and red regions of the spectrum or to incorporate blue, green, and red light within a single scanning beam that is divided and passed through blue, green, and red filters to form separate scanning beams for each color record. A simple technique is to scan the photothermographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et a' U.S. Pat. No. 5,107,346, Telle U.S. Pat. No. 5,105,266; MacDonald et al U.S. Pat. No. 5,105,469, and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden Digital Color Management, Addison-Wesley, 1998.

PREPARATIVE EXAMPLES

The following examples illustrate the synthesis of a representative coupler and other components useful in the invention.

Preparation of Coupler Y-5:

Referring to the reaction scheme shown below, ethyl benzoylacetate (55 g, 0.286 mol), 2-chloro-4-nitroaniline (47 g, 0.272 mol), and 150 mL of xylene were heated at reflux for 10 h under a slow stream of nitrogen that carried the hot vapors through an air-cooled condenser. Xylene was condensed and returned to the reaction mixture but ethanol was effectively removed from the reaction vessel to drive the condensation reaction to completion. The mixture was cooled and diluted with 150 mL of ether. The precipitate was filtered, washed with ether, and dried to 46.7 g of anilide. The filtrate was concentrated, diluted with 30 mL of xylene, and heated for 7 h with removal of ethanol as before. Cooling and dilution with ether provided another 12.7 g of product. A total of 54.4 g (69%) of anilide 1 was obtained. The nmr spectrum in deutero acetone indicated a 70:30 mixture of keto:enol forms of the anilide.

Anilide 1 (46.6 g, 0.146 mol) was slurried in 500 mL of methylene chloride. Sulfuryl chloride (12 mL, 0.149 mol) was added slowly before warming the mixture to reflux for about 30 min. An additional 1 m]L of sulfuryl chloride was added before allowing the homogenous mixture to stir at room temperature over night. The mixture was concentrated and crystallized from ether/heptane to yield 51.3 g (99%) of chloroanilide II.

Formic acid (96%, 14 mL, 0.35 mol) and triethylamine (45 mL, 0.32 mL) were mixed with 200 mL of dimethylformamide. Chloro coupler II (41.2 g, 0.1166 mol) was added and the solution was stirred at room temperature. for 1.5 h. The mixture was cooled in ice and 150 mL of 2 N HCl, 200 mL of water, 300 mL of ethyl acetate, and 50 mL of saturated NaCl were added sequentially. The organic layer was separated and washed once with water before concentrating and crystallizing the product from heptane/ether/ethyl acetate. Formate-substituted coupler III (34.1 g, 80%) was obtained.

Coupler III (34 g, 0.0937 mol) was slurried with 150 mL of THF at 45° before diluting the mixture with 100 mL of methanol and 2 mL of conc. sulfuric acid. The mixture was heated at 50° for about 10 min until it became homogeneous and then diluted with 150 mL of methanol. A thick suspension of product resulted after about 10 min. The suspension was cooled to about 10°, diluted with 100 mL methanol and 20 mL of water, filtered, washed with methanol, and dried to 23.5 g of needle-like solid. A second crop of 2.2 g was obtained for an overall yield of 82% of hydroxy coupler IV.

Hydroxy coupler IV (25.6 g, 0.0765 mol), 4-N-chlorocarbonyl-N-cyclopentylamino-2-methylbenzaldehyde (20.3 g, 0.0765 mol) [preparation described in U.S. Pat. No. 6,124,503], and 200 mL of methylene chloride were stirred mechanically under nitrogen atmosphere in a one liter round bottom flask. Dimethylamino pyridine (DMAP, 28 g, 3 equivalents) was added slowly and the mixture was heated to reflux briefly before cooling and stirring at room temperature. for 1 h. The mixture was washed with 2 N HCl, dried, and concentrated to 44.3 g of syrupy coupler VI.

2,4-Di-tert-pentylphenol (93.8 g, 0.4 mol), sodium nitrite (0.6 g, 0.009 mol), 60 mL of water, and 300 mL of propyl acetate were stirred mechanically in a one liter flask at 15–20°. Nitric acid (37.8 g of 70% acid, 0.42 mol) was added slowly via dropping funnel over 30 min keeping the temperature between 25 and 300. The mixture was then stirred vigorously for an additional hour before draining off the lower aqueous phase. The organic layer was washed with a solution of 21 g of sodium bicarbonate in 300 mL of water, passed through 9 g of activated charcoal, and concentrated under reduced pressure to an oil. Palladium catalyst (5 g of 5% Pd/C, 50% wet with water) was added to the oily nitrophenol dissolved in 240 mL of isopropyl alcohol. The mixture was heated with a 55° water bath before slowly adding over 1 h a solution of potassium formate (135 g, 1.6 mol) in 130 mL of water while keeping the temperature under 65°. After stirring an additional hour at 55–60°, the mixture was diluted with 300 mL of propyl acetate and 200 mL of warm water and filtered to remove catalyst. The catalyst was washed with 75 mL of propyl acetate and 75 mL of water. The combined propyl acetate layer was separated, washed with water and then brine, concentrated, and diluted with 200 mL of heptane to crystallize the product. After filtering and drying, 85.9 g (86%) of 2-amino-4,6-di-tert-pentylphenol were obtained.

The aminophenol (57.3 g, 0.23 mol) was combined with methyl cyanoacetate-imino ester hydrochloride VIII (40 g, 0.3 mol) [preparation given in U.S. Pat. No. 6,172,260] in 160 mL of dry methanol and heated at reflux for 1.5 h. Ethyl acetate (300 mL) was added to the cooled mixture before washing with water and then with brine. After concentration, the residual oil was dissolved in methylene chloride and passed through a small pad of silica gel using 20% ether in methylene chloride to elute product. Syrupy cyanomethyl benzoxazole VII (71 g) was obtained.

A mixture of coupler VI (7 g, 0.0124 mol), cyanomethyl benzoxazole VII (3.7 g, 0.0124 mol), 0.1 mL of piperidine, 0.3 mL of acetic acid, and 24 mL of ethyl acetate was heated at 60° for one h. The mixture was concentrated under reduced pressure to remove solvent, treated with 0.1 mL of triethylamine in 10 mL of ethyl acetate, and refrigerated overnight. The mixture was diluted with ethyl acetate, washed with 2N HCl and then water, concentrated, and chromatographed on 350 of silica gel. Product was eluted with 5:1 heptane:ethyl acetate and concentrated to 6.6 g (62%) of coupler Y-5 as an amorphous glass.

Preparation of Y-5
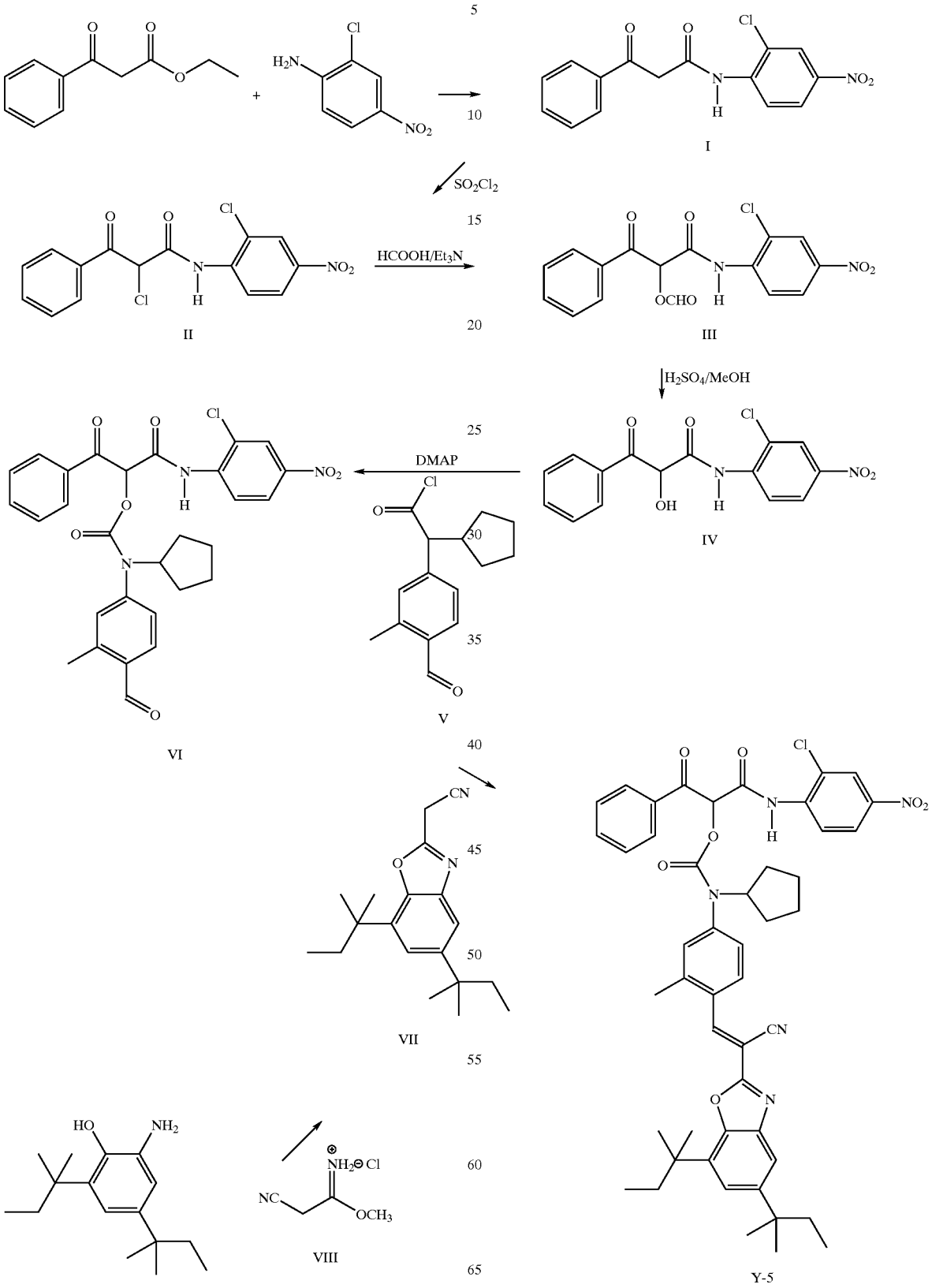

Preparation of Developing Agent D-2:

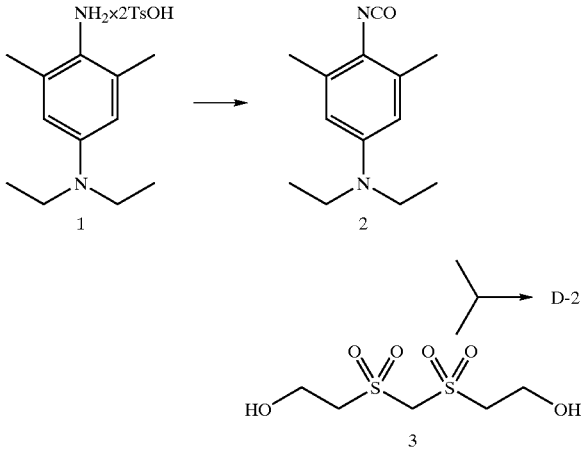

Preparation of 2:

Water (450 mL) was slowly added at 0° C. to a mixture of 2,6-dimethyl-4-(N,N-diethyl)aniline ditosylate (1) (268.4 g, 0.50 mol), potassium bicarbonate (500.6 g, 5.00 mol) and dichloromethane (900 mL), followed by a 1.9M toluene solution of phosgene (550 mL, 1.00 mol) at 4–7° C. over a period of 30 min. Following the addition, the mixture was stirred cold for 30 min and diluted with dichloromethane (750 mL) and water (1000 mL). The layers were separated and the aqueous one extracted with dichloromethane (350 mL). Combined organic solutions were dried over sodium sulfate and the solvents were distilled off in vacuo at 45° C. The crude product was dissolved in ligroin (700 mL), the solution treated with charcoal, filtered through SuperCel and concentrated in vacuo at 50° C., giving 111.0 g (0.50 mol, 100%) of isocyanate 2 as a yellow oil. $^1$H NMR ($CDCl_3$): δ 6.35 (s, 2H), 3.30 (q, 4H), 2.25 (s, 6H), 1.15 (t, 6H).

Procedure for Measuring pKas of Couplers in TRITONX-100 Media:

A solution of the coupler that was ca. 5E-3 M was made with 5.0 mL of dimethyl sulfoxide solvent. A 0.50-mL aliquot of the solution was added to 3.18 g of Triton X- 100 surfactant in a 50-mL volumetric flask. Then ca. 25 mL of ca. 40-deg C. distilled water was added while swirling vigorously. The solution was then cooled to ambient temperature and diluted to 50 mL with water. Various phosphate buffer solutions as potassium salts were prepared with pHs ranging from 3.73 to 12 with ionic strength of 0.75. Ionic strength computations were done using the three pKas for phosphoric acid. A 2.0-mL aliquot of the stock coupler solution was mixed with 2.0 mL of chosen buffer in a 5-dram vial. The mixture was swirled for ca. 20 s, transferred into a 1-cm square quartz cuvet, and the absorbance was measured by an HP 8452A spectrophotometer at a wavelength that showed the largest difference in absorption between acidic and basic pHs. A wavelength between 310 and 350 nm was typically chosen. The pH of the mixture was then measured with a CORNING Model 125 meter. A baseline reference blank spectrum was run with TRITON X-100 (surfactant) and pH 7 buffer. The data of corrected absorbances (differences from the blank spectrum) and pHs were used to compute by least-squares the pKa and the other two unknowns of high and low limiting densities. The pKa measurements are made with an experimental uncertainty within ±0.10, which depends on sources of material, the number of experimental points, number of replicates, and the like.

PHOTOGRAPHIC EXAMPLES

Processing conditions are as described in the following examples. Unless otherwise stated, the silver halide was removed after development by immersion in *Kodak Flexicolor Fix* solution. In general, an increase of approximately 0.2 in the measured density would be obtained by omission of this step. The following structures are used in the examples below.

CY-1

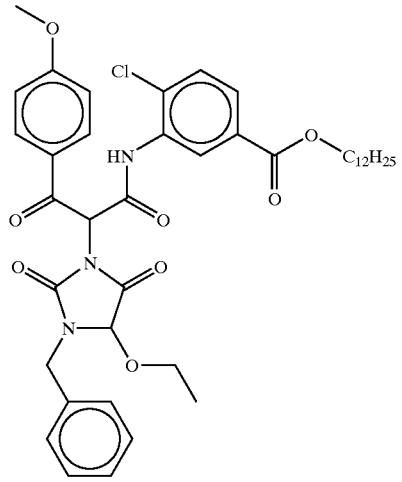

CY-2

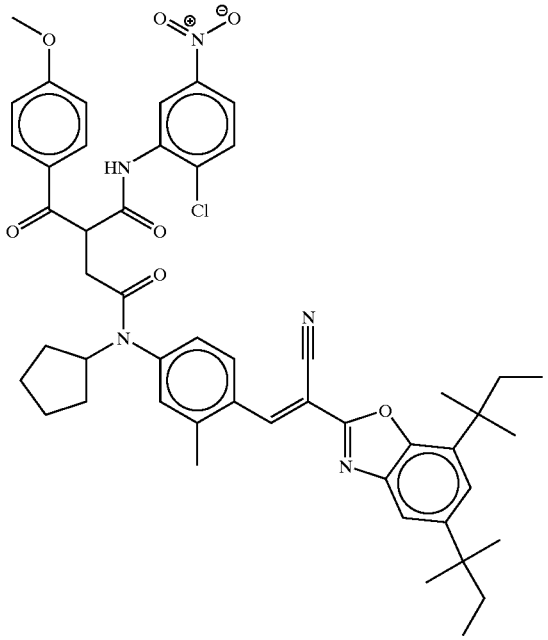

CY-3
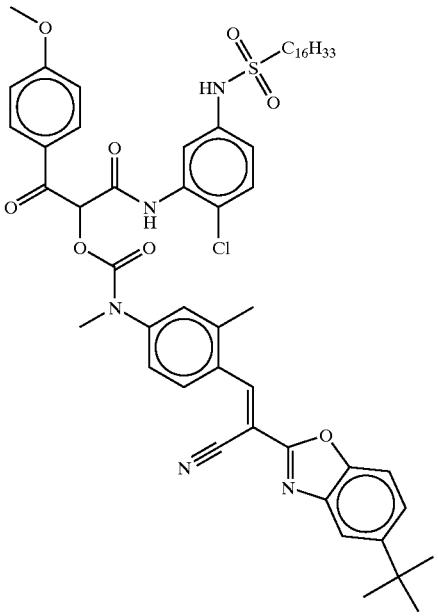
CY-4
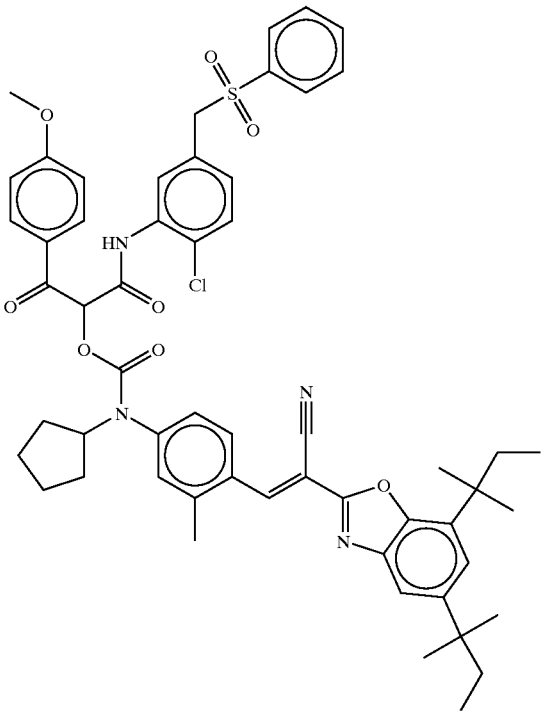
CY-5
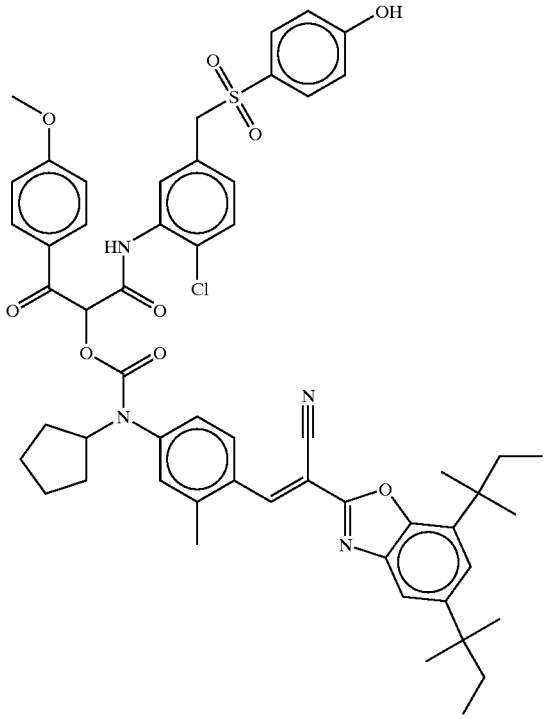
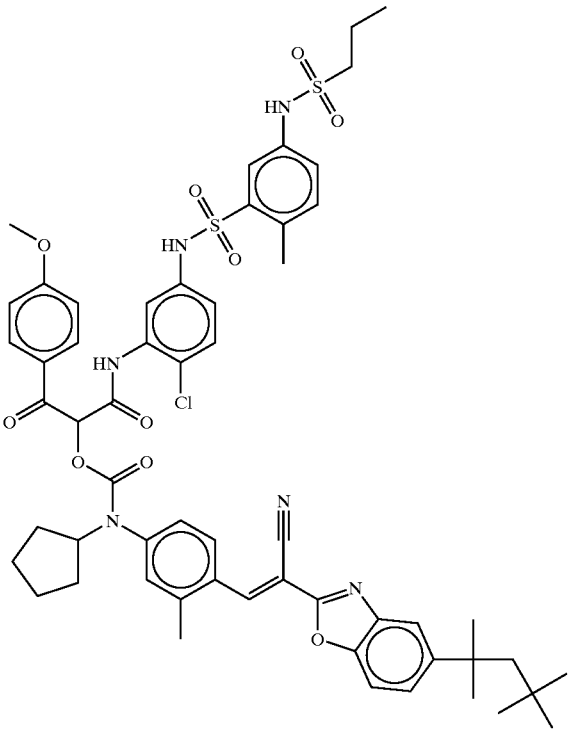

-continued
CY-7
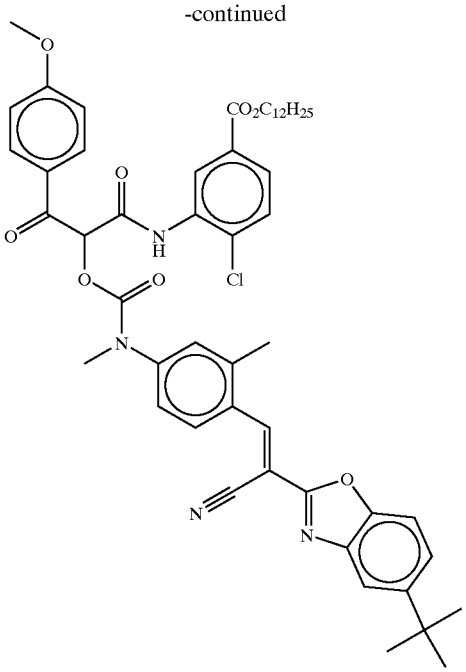
CY-8
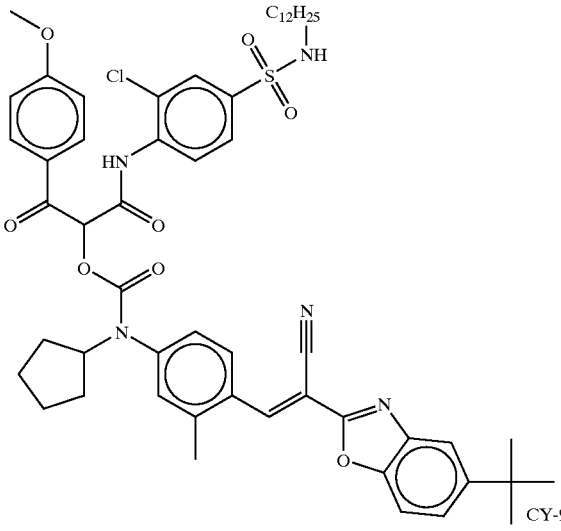
CY-9
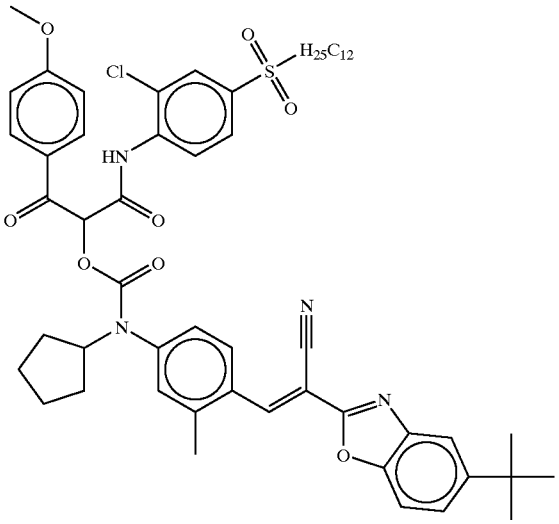
-continued
CY-10
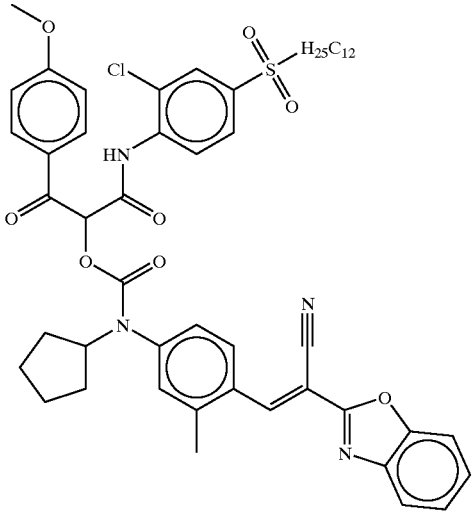
CY-11
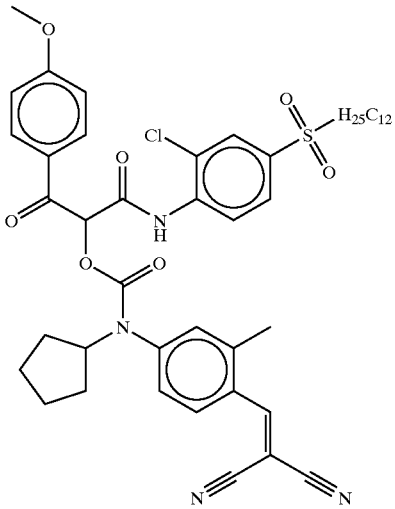
CY-12
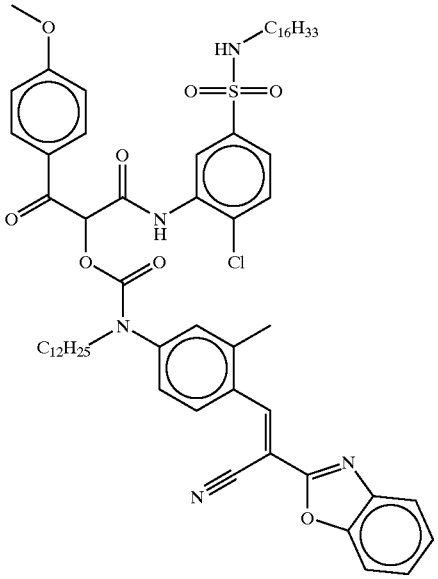

CY-13
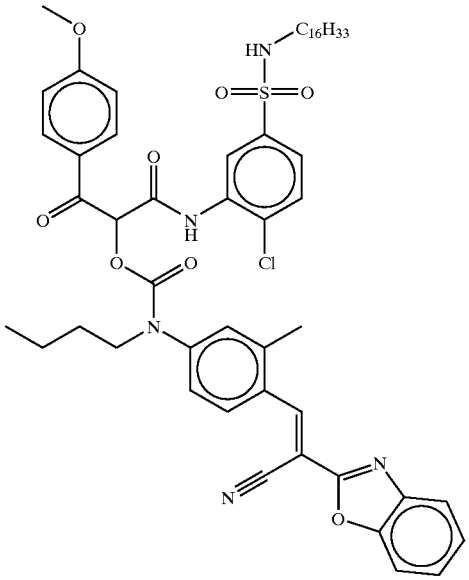
CY-14
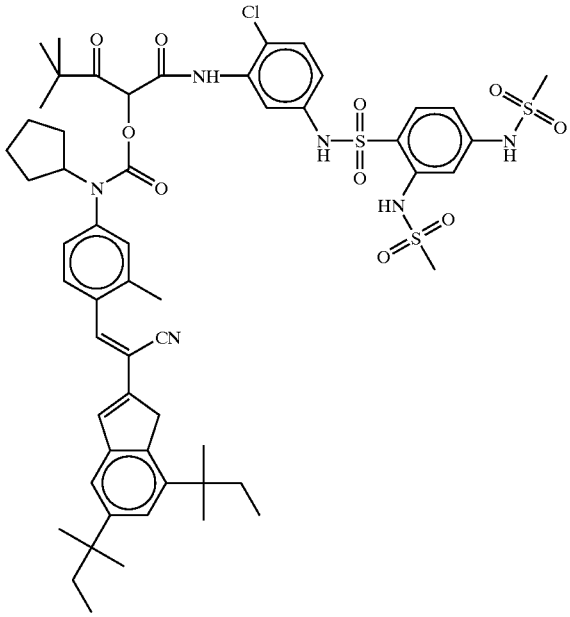
The various couplers according to the present invention including those that were tested are as follows:
Y-1
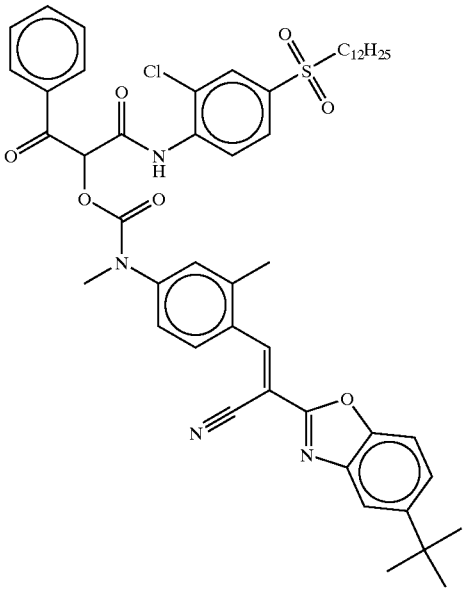
Y-2
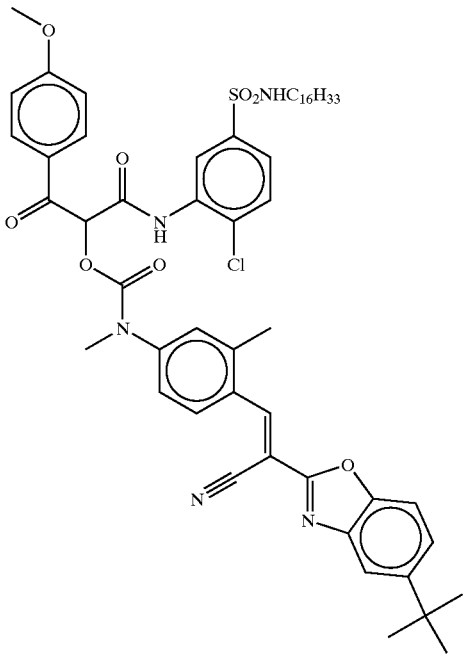

-continued
Y-4
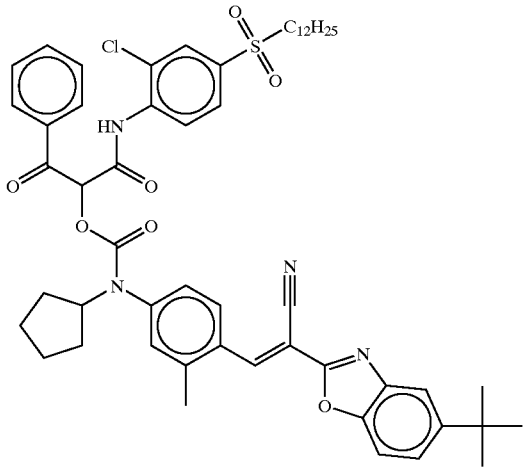
Y-5
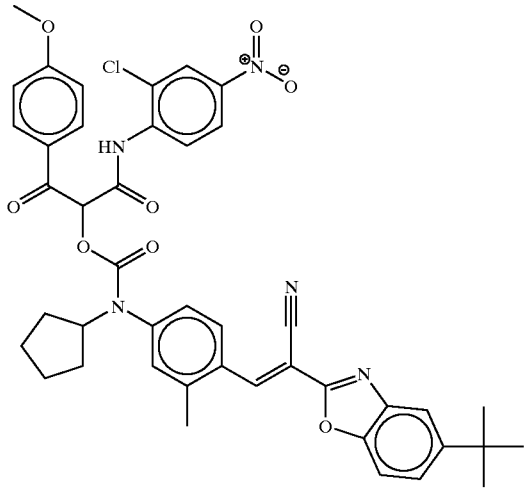
Y-6
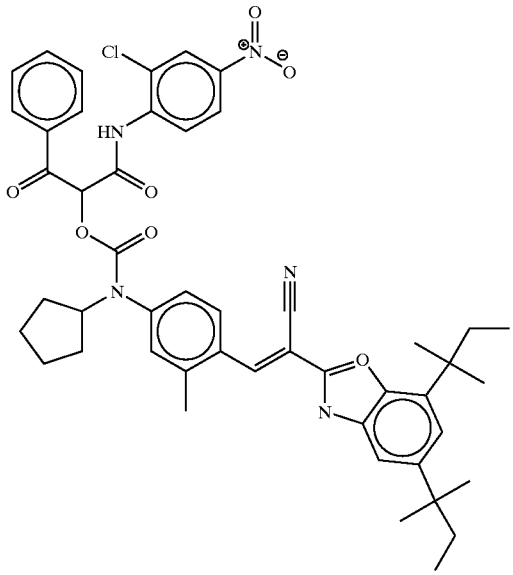
Y-7
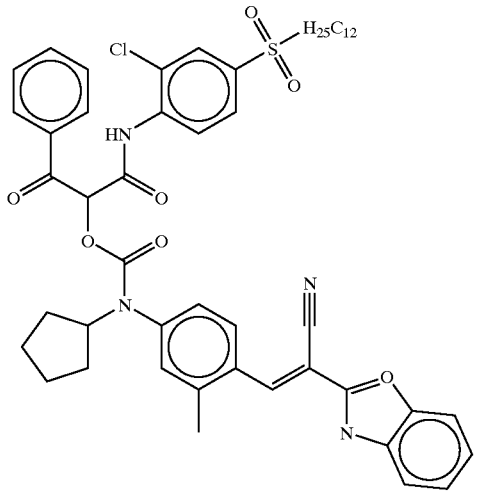
Y-8
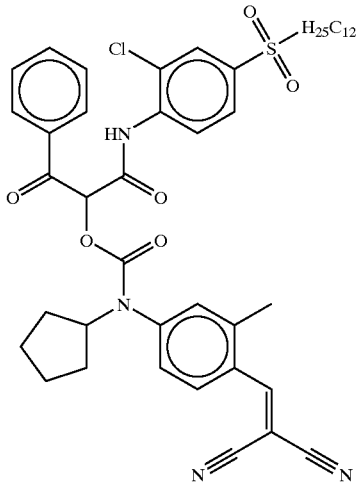
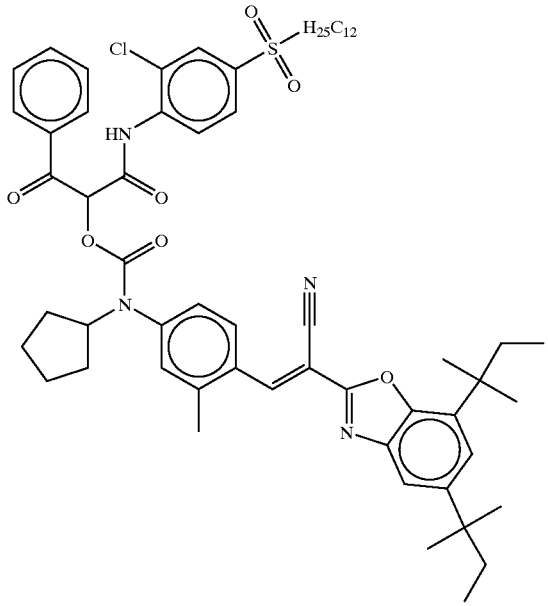

-continued

Y-9

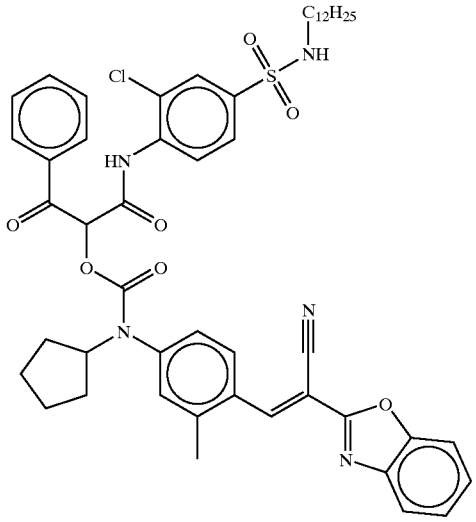

Y-10

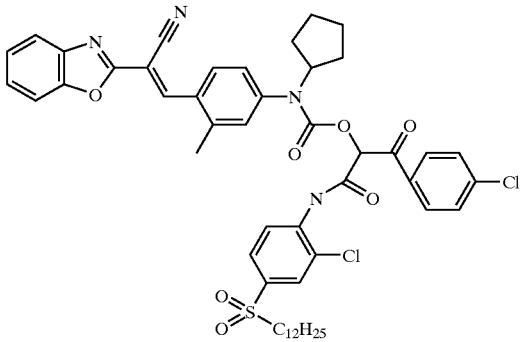

Y-11

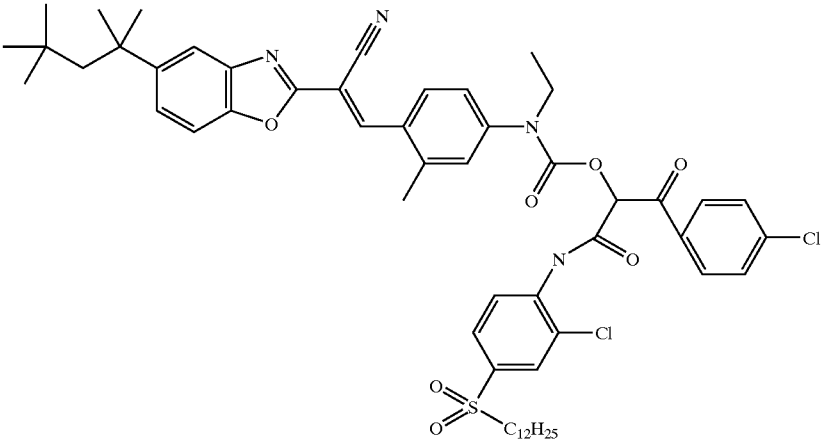

EXAMPLE 1

Coating examples according to the present invention were prepared on a 7-mil thick poly(ethylene terephthalate) support and comprised an emulsion containing layer (contents shown below in Table 2) with an overcoat layer of gelatin (0.22 g/m$^2$) and 1,1'-(methylenebis(sulfonyl))bis-ethene hardener (at 2% of the total gelatin concentration). Both layers contained spreading aids to facilitate coating.

TABLE 2

| Component | Laydown |
|---|---|
| Silver (from emulsion E-1) | 0.54 g/m$^2$ |
| Silver (from silver salt SS-1) | 0.32 g/m$^2$ |
| Silver (from silver salt SS-2) | 0.32 g/m$^2$ |

TABLE 2-continued

| Component | Laydown |
|---|---|
| Coupler | Varied |
| Developer D-1 | 0.86 g/m$^2$ |
| Salicylanilide | 0.86 g/m$^2$ |
| Lime-processed gelatin | 4.3 g/m$^2$ |

Comparison conventional coupler CY-1 was coated at 0.72 mmol/m$^2$; Inventive and comparison dye releasing couplers were coated at half this molar level, 0.36 mmol/m$^2$.

Common Components:

Silver salt dispersion SS-1:

A stirred reaction vessel was charged with 431 g of lime-processed gelatin and 6569 g of distilled water. A solution containing 214 g of benzotriazole, 2150 g of distilled water, and 790 g of 2.5 M sodium hydroxide was prepared (Solution B). The starting mixture in the reaction vessel was adjusted to a pAg of 7.25 and a pH of 8.00 by additions of Solution B, nitric acid, and sodium hydroxide as needed.

A 4-L solution of 0.54 M silver nitrate was added to the kettle at 250 cc/min, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of silver benzotriazole.

Silver salt dispersion SS-2:

A stirred reaction vessel was charged with 431 g of lime-processed gelatin and 6569 g of distilled water. A solution containing 320 g of 1-phenyl-5-mercaptotetrazole, 2044 g of distilled water, and 790 g of 2.5 molar sodium hydroxide was prepared (Solution B). The mixture in the reaction vessel was adjusted to a pAg of 7.25 and a pH of 8.00 by additions of Solution B, nitric acid, and sodium hydroxide as needed.

A 4 L solution of 0.54 M silver nitrate was added to the kettle at 250 cc/min, and the pAg was maintained at 7.25 by a simultaneous addition of solution B. This process was continued until the silver nitrate solution was exhausted, at which point the mixture was concentrated by ultrafiltration. The resulting silver salt dispersion contained fine particles of the silver salt of 1-phenyl-5-mercaptotetrazole.

Emulsion E-1:

A tabular emulsion was prepared with composition of 98% silver bromide and 2% silver iodide and an equivalent circular diameter of 0.42 microns and a thickness of 0.06 microns. The emulsion was spectrally sensitized to blue light by addition of sensitizing dyes and then chemically sensitized for optimum performance.

Coupler Dispersions:

For each inventive or comparative coupler except CY-1 an oil-based, coupler dispersion was prepared containing the appropriate dye releasing couplerdi-n-butyl phthalate, and ethyl acetate in the ratio of 1:1:3 by weight. To this oil phase was added a solution of gelatin and surfactant in water and the mixture was milled repeatedly to give a final coupler dispersion that was 3% by weight coupler and 6% by weight gelatin.

The comparison coupler CY-1 were similarly dispersed using di-n-butyl phthalate in the ratio of 1 part coupler to 0.5 part solvent to give a final composition that was 9% coupler and 6.5 % gelatin.

Incorporated Developer (D-12):

The following blocked developing agent was used:

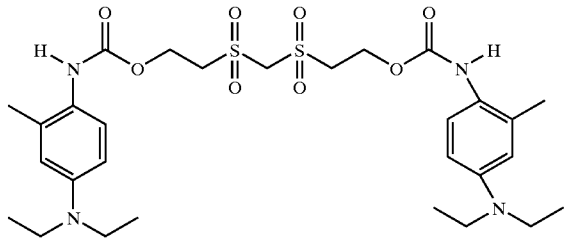

This material was ball-milled in an aqueous mixture for 4 days using Zirconia beads in the following formula. For 1 g of incorporated developer, sodium tri-isopropylnaphthalene sulfonate (0.1 g), water ( to 10 g), and beads (25 mL), were used. In some cases, after milling, the slurry was diluted with warm (40° C.) gelatin solution (12.5%, 10 g) before the beads were removed by filtration. The, filtrate (with or without gelatin addition) was stored in a refrigerator prior to use.

Salicylanilide:

A dispersion of salicylanilide was prepared by the method of ball milling. To a total 20 g sample was added 3.0 g salicylanilide solid, 0.20 g polyvinylpyrrolidone, 0.20 g TRITON X-200 surfactant, 1.0 g gelatin, 15.6 g distilled water, and 20 mL of zirconia beads. The slurry was ball milled for 48 h. Following milling, the zirconia beads were removed by filtration. The slurry was refrigerated prior to use. For preparations on a larger scale, the salicylanilide was media—milled to give a final dispersion containing 30% salicylanilide, with 4% TRITON X 200 surfactant and 4% polyvinylpyrrolidone added relative to the weight of salicylanilide. In some cases the dispersion was diluted with water to 25% salicylanilide or gelatin (5% of total) was added and the concentration of salicylanilide adjusted to 25%. (Biocide may be added.)

Coating Evaluation:

The resulting coatings were exposed through a 0–4 density step wedge to a 3.04 log lux light source at 3000K filtered by Daylight 5A and Wratten 2B filters. The exposure time was 0.5 s. After exposure, the coating was thermally processed by contact with a heated platen for 20 s. A number of strips were processed at a variety of platen temperatures in order to check the generality of the effects that were seen. Performance results are shown in Table 3 below for processing at 150 deg C. which was the optimum process condition for sensitometric performance. From the data collected, three parameters were obtained:

| | |
|---|---|
| Dmax: | The density at maximum exposure. |
| Drange: | The density difference between maximum and minimum densities formed by development. Drange = (Dmax − Dmin). |
| Gamma: | From the Characteristic curve, the maximum 2-point contrast between any two measured density steps that are separated by one intervening step. |

-continued

| | |
|---|---|
| Amplification | Drange/(molar laydown/$m^2$ of coupler). |
| Rel Amplification | Amplification for the test coupler/Amplification for CY-1 |

These parameters provide useful measures to compare coupler performance, by density forming ability and rate of density formation with exposure.

TABLE 3

| ID | Type | pKa | Blue Dmax | Gamma | Drange | Amplification | Rel. Amp. |
|---|---|---|---|---|---|---|---|
| CY-1 | Comparative. (Non-HDY coupler) | 5.1 | 1.15 | 0.86 | 0.92 | 1278 | (1.0) |
| CY-14 | Comparative | 11.2 | 0.38 | 0.23 | 0.29 | 817 | 0.6 |
| CY-4 | Comparative | 10.6 | 0.98 | 0.75 | 0.78 | 2172 | 1.7 |
| CY-6 | Comparative | 10.1 | 0.89 | 0.67 | 0.74 | 2061 | 1.6 |
| CY-5 | Comparative | 10.0 | 1.18 | 0.87 | 0.91 | 2522 | 2.0 |
| CY-3 | Comparative | 9.2 | 1.00 | 0.63 | 0.67 | 1864 | 1.5 |
| CY-7 | Comparative | 9.1 | 1.08 | 0.78 | 0.82 | 2289 | 1.8 |
| CY-12 | Comparative | 8.7 | 1.34 | 1.03 | 1.17 | 3236 | 2.5 |
| Y-2 | Inventive | 8.5 | 1.30 | 1.01 | 1.09 | 3019 | 2.4 |
| Y-1 | Inventive | 7.4 | 1.89 | 1.32 | 1.38 | 3822 | 3.0 |

The inventive couplers show both high amplifications and relative amplifications compared to the comparative examples that are known from the prior art.

EXAMPLE 2

This set of coatings was prepared to have similar components and format to Example 1. Strips were processed using a heated drum processor and optimum conditions were 161° C. for 18 s. The performance results are shown in Table 4 below.

TABLE 4

| ID | Type | pKa | Blue Dmax | Gamma | Drange | Amplification | Rel. Amp. |
|---|---|---|---|---|---|---|---|
| CY-1 | Comparative (Non-HDY coupler) | 5.1 | 0.94 | 0.69 | 0.79 | 1103 | (1.0) |
| Y-4 | Inventive | 8.2 | 0.86 | 0.58 | 0.71 | 1967 | 1.8 |
| Y-3 | Inventive | 7.8 | 1.23 | 0.80 | 0.89 | 2467 | 2.2 |
| Y-1 | Inventive | 7.4 | 1.59 | 1.11 | 1.19 | 3314 | 3.0 |

Again, the inventive couplers showed comparatively high amplification as shown by the results in Table 4 above.

EXAMPLE 3

This set of coatings was prepared to have similar components and format to Example 2, with the exception that Emulsion E2 replaced E1. Emulsion E2 was sensitized to green light, a tabular emulsion with a composition of 96% silver bromide and 4% silver iodide, an equivalent circular diameter of 1.2 microns and a thickness of 0.12 microns. Strips were processed using a heated drum processor and optimum conditions were 161° C. for 18 s. The performance results are shown in Table 5 below.

TABLE 5

| ID | Type | pKa | Blue Dmax | Gamma | Drange | Amplification | Rel. Amp. |
|---|---|---|---|---|---|---|---|
| CY-1 | Comparative (Non-HDY coupler) | 5.1 | 0.58 | 0.33 | 0.48 | 663 | (1.0) |
| CY-8 | Comparative | 9.5 | 0.65 | 0.32 | 0.52 | 1442 | 2.2 |
| CY-9 | Comparative | 9.3 | 0.7 | 0.41 | 0.55 | 1531 | 2.3 |

TABLE 5-continued

| ID | Type | pKa | Blue Dmax | Gamma | Drange | Amplification | Rel. Amp. |
|---|---|---|---|---|---|---|---|
| CY-10 | Comparative | 8.9 | 0.79 | 0.46 | 0.61 | 1683 | 2.5 |
| Y-8 | Inventive | 7.9 | 1 | 0.61 | 0.85 | 2347 | 3.5 |
| Y-3 | Inventive | 7.8 | 0.93 | 0.62 | 0.68 | 1889 | 2.9 |
| Y-6 | Inventive | 7.7 | 1.11 | 0.71 | 0.90 | 2508 | 3.8 |
| Y-7 | Inventive | 7.6 | 0.81 | 0.36 | 0.54 | 1486 | 2.2 |
| Y-1 | Inventive | 7.4 | 1.06 | 0.6 | 0.85 | 2353 | 3.6 |
| Y-5 | Inventive | 7.4 | 1.13 | 0.76 | 0.94 | 2600 | 3.9 |

The inventive couplers show high relative amplifications relative to comparisons. The inventive coupler Y-7 formed a malononitrile-based dye that may have partially washed out during aqueous removal of the silver halide, so reducing the observed Drange.

EXAMPLE 4

This set of coatings was prepared to have similar components and format to Example 3. Strips were processed using a heated drum processor and optimum conditions were 161° C. for 18 s. The performance results are shown in Table 6 below.

TABLE 6

| ID | Type | pKa | Blue Dmax | Gamma | Drange | Amplification | Rel. Amp. |
|---|---|---|---|---|---|---|---|
| CY-1 | Comparative (Non-HDY coupler) | 5.1 | 0.57 | 0.36 | 0.47 | 651 | (1.0) |
| CY-11 | Comparative | 8.8 | 0.63 | 0.22 | 0.38 | 1050 | 1.6 |
| Y-7 | Inventive | 7.6 | 0.92 | 0.48 | 0.71 | 1972 | 3.0 |

CY-11 may also have lower Drange as with Y-7. The effect of low pKa resulting in high amplification is seen with Y-7.

EXAMPLE 5

This set of coatings was prepared to have similar components and format to Example 3. Strips were processed using a heated drum processor and optimum conditions were 161° C. for 18 s. The performance results are shown in Table 7 below.

TABLE 7

| ID | Type | pKa | Blue Dmax | Gamma | Drange | Amplification | Rel. Amp. |
|---|---|---|---|---|---|---|---|
| CY-1 | Comparative (Non-HDY coupler) | 5.1 | 0.59 | 0.31 | 0.46 | 632 | (1.0) |
| CY-13 | Comparative | 8.8 | 0.6 | 0.24 | 0.44 | 1222 | 1.9 |
| CY-12 | Comparative | 8.7 | 0.55 | 0.22 | 0.42 | 1153 | 1.8 |
| Y-9 | Inventive | 8.0 | 1.04 | 0.51 | 0.80 | 2208 | 3.5 |
| Y-1 | Inventive | 7.4 | 1.08 | 0.69 | 0.77 | 2144 | 3.4 |

Thus, as shown by the above results, the couplers of the present invention show comparatively high amplification.

EXAMPLE 6

This set of coatings was prepared to have similar components to example 3 except the emulsion E-2 was coated at 0.86 g/m$^2$ and the couplers were all coated at 0.72 mmol/m$^2$. The performance results are in Table 8.

TABLE 8

| ID | Type | pKa | Blue Dmax | Gamma | Dmax-Dmin | Amplification | Rel. Amp. |
|---|---|---|---|---|---|---|---|
| CY-1 | Comparison (Non-HDY coupler) | 5.1 | 1.05 | 0.74 | 0.7 | 972 | (1.0) |
| Y-6 | Inventive | 7.8 | 2.35 | 1.57 | 1.89 | 2626 | 2.7 |
| Y-10 | Inventive | 7.2 | 2.57 | 1.67 | 2.19 | 3042 | 3.1 |
| Y-11 | Inventive | 7 | 2.55 | 1.57 | 2.26 | 3140 | 3.2 |

This example shows that lower pKa HDY couplers Y-6, Y-10, and Y-11 are advantageous relative to CY-1. These data were generated by processing at 164° C. for 18 s.

What is claimed is:

1. A photographic element containing a light-sensitive silver halide emulsion layer having associated therewith a yellow HDY coupler represented by the following structure:

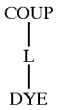

wherein

COUP is a photographic coupler residue capable of coupling with an oxidized color developer to form a first dye, which coupler is an acetanilide compound in which the pKa at the coupling site, comprising a carbon atom to which L and a hydrogen atom are attached, is less than that of compound CY-12;

L is a linking group selected from the group consisting of —OC(=O)—, —OC(=S)—, —SC(=O)—, and —SC(=S)—, and DYE is a releasable second dye or dye precursor that produces the same color as the first dye, wherein CY-12 has the following structure:

CY-12

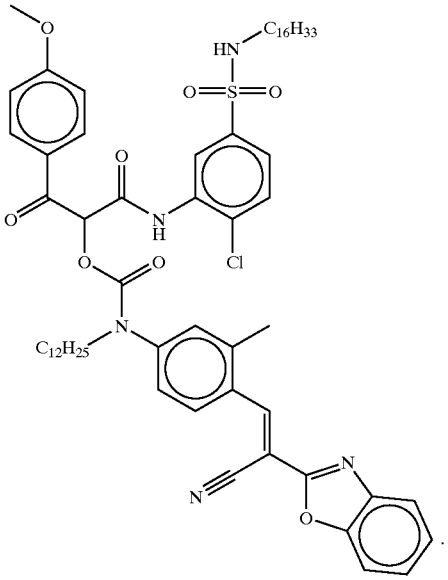

2. The photographic element of claim 1 wherein the photographic coupler residue COUP contains a sufficient number of electron-withdrawing groups to lower the pKa at the coupling site to less than the pKa of compound CY-12 at the coupling site.

3. The photographic element of claim 2 wherein the photographic coupler residue COUP comprises a substituted or unsubstituted carbonamido aryl or heterocyclic ring on one side of said carbon atom and a cyano or an acyl group on the other side of said carbon atom, which acyl group comprises a substituted or unsubstituted aryl, alkyl, cyclic alkyl, amino, alkoxy or heterocylic moiety, wherein one or more electron-withdrawing groups are attached to one or more of said aryl or heterocyclic ring, and said aryl, alkyl, cyclic alkyl, amino, alkoxy or heterocylic moiety.

4. The photographic element of claim 3 wherein the photographic coupler residue COUP comprises a substituted or unsubstituted carbonamido aryl or heterocyclic ring on one side of said carbon atom and an acyl group on the other side of said carbon atom, which acyl group comprises a substituted or unsubstituted aryl, cyclic alkyl, alkoxy or heterocylic moiety, wherein one or more electron-withdrawing groups are attached to one or more of said aryl or heterocyclic ring, and said aryl, cyclic alkyl, alkoxy or heterocylic moiety.

5. The photographic element of claim 1 wherein the yellow HDY coupler is represented by the following structure:

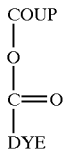

wherein the releasable second dye is a methine dye linked to the OC=O by a moiety of the DYE having the following structure:

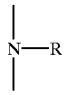

wherein R is an organic substituent.

6. The photographic element of claim 1 wherein the pKa at the coupling site of the yellow HDY coupler is at least 0.1 units less than the pKa at the coupling site of CY-12.

7. The photographic element of claim 1 wherein the pKa at the coupling site of the yellow HDY coupler is at least 0.2 units less than the pKa at the coupling site of CY-12.

8. The photographic element of claim 1 wherein the sum of the total sigma values of the electron-withdrawing groups on COUP is at least 0.50, and the pKa at the coupling site of the yellow HDY coupler is at at least 0.7 units less than the pKa at the coupling site of CY-12.

9. The photographic element of claim 1 wherein the pKa at the coupling site of the yellow HDY coupler is at least 1.0 unit less than the pKa at the coupling site of CY-12.

10. The photographic element of claim 1 in which the electron-withdrawing group is selected from the group consisting of —$SO_2R'$, —$SO_2NHR'$, SOR', —$OSO_2R'$, —$NO_2$, halogen, —$NHSO_2R'$, —CN, —$SO_2CF_3$, —OAr, —$CO_2R'$, —$CF_3$, —COOR', —CONR', —COR', and —OCOR' where R' is a substituted or unsubstituted organic moiety.

11. The element of claim 1 in which DYE is an azo or methine dye.

12. The element of claim 11 in which the DYE contains a benzoxazole group.

13. The element of claim 1 wherein the DYE is represented by the following structure:

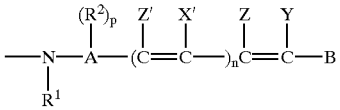

wherein $R^1$ is hydrogen or a substituted or unsubstituted alkyl or aryl group; A is a substituted or unsubstituted aryl ring containing up to three optional substituents $R^2$; each Z, Z', and Y' is independently hydrogen or a substituent; Y is an electron withdrawing group; and n, which represents the number of conjugated vinyl groups and affects the hue of the dye, is 0, 1, or 2; and B is a heterocycle having the formula:

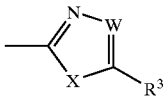

wherein X is O, S, or $N(R^5)$ where $R^5$ is hydrogen or alkyl of up to 22 carbon atoms; W is N or $C(R^4)$ where $R^4$ is hydrogen or a substituent; $R^3$ is a substituent linked to the heterocycle by a carbon or nitrogen atom of the substituent, wherein $R^3$ and $R^4$ may be linked to form a ring.

14. The element of claim 13 wherein $R^1$ is hydrogen, unsubstituted or substituted alkyl, which alkyl contains 1 to 18 carbon atoms, or unsubstituted or substituted aryl.

15. The element of claim 13 wherein A is a phenyl, naphthyl, or thiazole ring.

16. The element of claim 13 wherein each $R^2$ is independently a substituted or unsubstituted alkyl group which may form a ring with Z', and p is an integer from 0 to 3, and one or more $R^2$ substituents may be present which preferably include alkyl groups of from 1 to 5 carbon atoms.

17. The element of claim 13 wherein $R^3$ is a substituted or unsubstituted alkyl or aryl group.

18. The element of claim 13 wherein $R^3$ and $R^4$ are linked to form a phenyl ring and that Z is hydrogen, W is $C(R^4)$, and X is oxygen; and the ring contains one or more substituents of up to 20 carbon atoms each such as alkyl groups.

19. The element of claim 1 wherein COUP is represented by the following structure:

IA

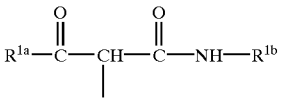

wherein $R^{1a}$ or $R^{1b}$ contains a ballast or anti-diffusing group selected so that the total number of carbon atoms is from 8 to 32;

$R^{1a}$ is an aryl, heterocyclic, alkyl, cyclic alkyl, or amino group;

$R^{1b}$ is an aryl or heterocyclic group.

20. The element of claim 19 wherein $R^{1a}$ is a phenyl or heteroaryl group optionally substituted with groups having not more than 32 carbon.

21. The element of claim 19 wherein COUP is represented by the following structure:

IIIA

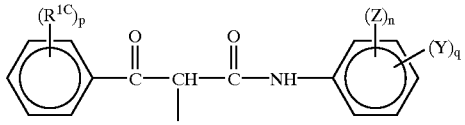

wherein Y is an electron-withdrawing group; Z is a non-electron-withdrawing group; $R^{1c}$ is a substituent; q is 1 to 4, and each of n and p is 0 to 5.

22. The element of claim 21 wherein the sigma (σ) value of the Y group is greater than 0.2 and the sigma (σ) total value ($\sigma_{total}$) of all substituents Y, Z, and $R^{1c}$ is greater that 0.5.

23. The light sensitive element of claim 1, wherein the element comprises a red-light-sensitive-layer unit, a green-light-sensitive layer unit and a blue-light-sensitive layer unit, wherein at least one layer unit has in reactive association a blocked developer and the dye forming coupler of claim 1.

24. The light sensitive element of claim 1, wherein the element comprises a red light sensitive layer unit, a green light sensitive layer unit and a blue light sensitive layer unit and wherein all three layer units have in reactive association an independently selected dye-forming coupler and an independently selected blocked developer, wherein the dye-forming coupler is different in each layer unit and the developing agent is the same in all the layer units.

25. The element of claim 1, wherein the element, after imagewise exposure is capable of being developed by heat treatment.

26. A color photothermographic element comprising at least three light-sensitive units which have their individual sensitivities in different wavelength regions, each of the units comprising at least one light-sensitive silver-halide emulsion, binder, and dye-providing coupler, and a blocked developer, wherein at least one imaging layer comprises a yellow HDY coupler represented by the following structure:

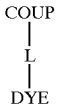

wherein

COUP is a photographic coupler residue capable of coupling with an oxidized color developer to form a first dye, which coupler is an acetanilide compound in which the pKa at the coupling site, comprising a carbon atom to which L and a hydrogen atom are attached, is less than that of compound CY-12;

L is a linking group selected from the group consisting of —OC(=O)—, —OC(=S)—, —SC(=O)—, and —SC(=S)—, and DYE is a releasable second dye or dye precursor that produces the same color as the first dye, wherein CY-12 has the following structure:

CY-12

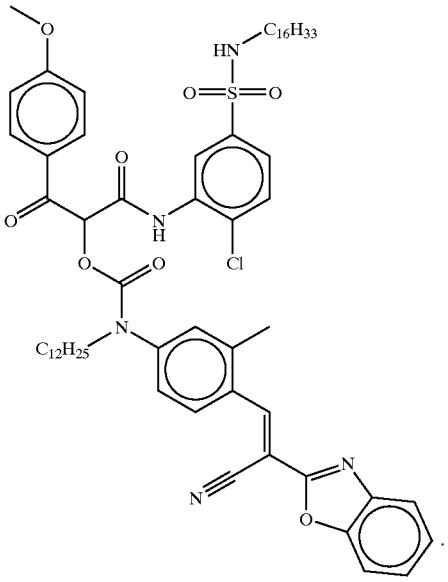

27. The element of claim 24 wherein the pKa at the coupling site of the yellow HDY coupler is is at least 0.1 units less than the pKa at the coupling site of CY-12.

28. The element of claim 26 wherein the pKa at the coupling site of the yellow HDY coupler is at least 0.2 units less than the pKa at the coupling site of CY-12.

29. A photothermographic element according to claim 26 wherein the photothermographic element contains an imaging layer comprising, in addition to the blocked developer, a light sensitive silver halide emulsion, and a non-light sensitive silver salt oxidizing agent.

30. A photothermographic element according to claim 26 that is capable of dry development without the application of aqueous solutions.

31. A method of image formation comprising the step of developing an imagewise exposed photothermographic element comprising at least three light-sensitive units which have their individual sensitivities in different wavelength regions, each of the units comprising at least one light-sensitive silver-halide emulsion, binder, and dye-providing coupler, wherein at least one of the units comprise a coupler as described in claim 1.

32. A method according to claim 31, wherein said element further comprises a blocked developer and wherein said developing comprises treating said imagewise exposed element at a temperature between about 80° C. and about 180° C. for a time ranging from about 0.5 to about 60 seconds.

33. A method according to claim 31, wherein said developing comprises treating said imagewise exposed element to a volume of processing solution less than 1 times the volume of solution required to swell fully the photographic element.

34. A method according to claim 31, wherein the developing is accompanied by the application of a laminate sheet containing additional processing chemicals.

35. A method according to claim 31 wherein image formation comprises the step of scanning an imagewise exposed and developed imaging element to form a first electronic image representation of said imagewise exposure.

36. A method according to claim 35 wherein the image formation comprises the step of digitizing a first electronic image representation formed from an imagewise exposed, developed, and scanned imaging element to form a digital image.

37. A method according to claim 36 wherein image formation comprising the step of modifying a first electronic image representation formed from an imagewise exposed, developed, and scanned imaging element to form a second electronic image representation.

38. A method according to claim 31 comprising storing, transmitting, printing, or displaying an electronic image representation of an image derived from an imagewise exposed, developed, scanned imaging element.

39. A method according to claim 38, wherein printing the image is accomplished with any of the following printing technologies: electrophotography, inkjet, thermal dye sublimation, or CRT or LED printing to sensitized photographic paper.

* * * * *